US011335236B2

(12) United States Patent
Zhou et al.

(10) Patent No.: US 11,335,236 B2
(45) Date of Patent: May 17, 2022

(54) IMAGE PROCESSING METHOD AND DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Zhiheng Zhou, Beijing (CN); Tiankuo Shi, Beijing (CN); Yue Li, Beijing (CN); Xiaomang Zhang, Beijing (CN); Jingpeng Zhao, Beijing (CN); Yifan Hou, Beijing (CN); Zhihua Ji, Beijing (CN); Yilang Sun, Beijing (CN); Yifang Chu, Beijing (CN); Chuanjun Liu, Beijing (CN); Xin Duan, Beijing (CN); Lingyun Shi, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 17 days.

(21) Appl. No.: 16/916,762

(22) Filed: Jun. 30, 2020

(65) Prior Publication Data

US 2021/0193018 A1 Jun. 24, 2021

(30) Foreign Application Priority Data

Dec. 18, 2019 (CN) ..... 201911312530.9

(51) Int. Cl.
*G09G 5/10* (2006.01)
*G09G 3/20* (2006.01)

(52) U.S. Cl.
CPC ..... *G09G 3/2074* (2013.01); *G09G 3/2003* (2013.01); *G09G 2300/0452* (2013.01); *G09G 2320/062* (2013.01)

(58) Field of Classification Search
CPC .. G09G 3/2074; G09G 3/0626; G09G 3/2003; G09G 2300/0452; G09G 2310/027; G09G 2320/062; G09G 2340/0457
(Continued)

(56) References Cited

U.S. PATENT DOCUMENTS

2015/0371583 A1 12/2015 Guo et al.
2016/0329026 A1* 11/2016 Lu ..... G09G 5/02
(Continued)

FOREIGN PATENT DOCUMENTS

CN 103886825 A 6/2014

OTHER PUBLICATIONS

CN103886825A, English Abstract and U.S. Equivalent U.S. Pub. No. 2015/0371583.

*Primary Examiner* — Jennifer T Nguyen
(74) *Attorney, Agent, or Firm* — Brooks Kushman P.C.

(57) ABSTRACT

The present disclosure provides an image processing method and a display device including rows of actual pixels each including actual sub-pixels, and starting positions of actual sub-pixels in odd-numbered and even-numbered rows are staggered by a distance of half of an actual sub-pixel. The method includes: determining rows of theoretical pixels corresponding to a to-be-displayed image, each theoretical pixel including theoretical sub-pixels, each actual pixel corresponding to at least two theoretical pixels; calculating grayscale data of each actual sub-pixel in a manner of: for a target actual pixel, determining a rendering mode for calculating grayscale data of each actual sub-pixel of the target actual pixel according to whether there is a specified
(Continued)

detail feature in a pixel area where target theoretical pixels corresponding to the target actual pixel are located, different rendering modes are employed when there is or there is not a specified detail feature in the pixel area.

18 Claims, 9 Drawing Sheets

(58) Field of Classification Search
USPC ..... 345/694
See application file for complete search history.

(56) References Cited

U.S. PATENT DOCUMENTS

2016/0358536 A1* 12/2016 Li ..... G09G 3/2003
2018/0277049 A1* 9/2018 Pan ..... G09G 3/2074

* cited by examiner

IMAGE PROCESSING METHOD AND DISPLAY DEVICE

CROSS-REFERENCE TO RELATED APPLICATION

This application claims priority to Chinese Application No. 201911312530.9, filed on Dec. 18, 2019, the which is incorporated by herein reference in its entirety.

TECHNICAL FIELD

The present disclosure relates to the field of image processing technologies, and in particular to an image processing method and a display device.

BACKGROUND

In the related art, there is a pixel array called a pixel array with a BV3 structure. The pixel array includes multiple rows of actual pixels. Each actual pixel includes multiple actual sub-pixels. Starting positions of the actual sub-pixels in odd-numbered and even-numbered rows are staggered by a distance of half of an actual sub-pixel.

However, for some images with obvious detailed features, such as bright lines on a dark background, bright points on a dark background, checkerboard and other detailed features, the above pixel array cannot effectively render when displaying images, which will result in loss of detailed features in the image.

SUMMARY

In a first aspect, one embodiment of the present disclosure provides an image processing method applied to a display device which includes a plurality of rows of actual pixels, each actual pixel includes a plurality of actual sub-pixels, and starting positions of the actual sub-pixels in odd-numbered and even-numbered rows are staggered by a distance of half of an actual sub-pixel. The method includes: determining a plurality of rows of theoretical pixels corresponding to a to-be-displayed image, wherein each theoretical pixel includes a plurality of theoretical sub-pixels, and each actual pixel corresponds to at least two theoretical pixels; calculating grayscale data of each actual sub-pixel of each actual pixel. The calculating grayscale data of each actual sub-pixel of each actual pixel, includes: for a target actual pixel, determining a rendering mode for calculating the grayscale data of each actual sub-pixel of the target actual pixel according to whether there is a specified detail feature in a pixel area where target theoretical pixels corresponding to the target actual pixel are located, wherein when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed.

In a second aspect, one embodiment of the present disclosure provides a display device including: a plurality of rows of actual pixels, wherein each actual pixel includes a plurality of actual sub-pixels, and starting positions of the actual sub-pixels in odd-numbered and even-numbered rows are staggered by a distance of half of an actual sub-pixel. The display device further includes: a determination circuit configured to determine a plurality of rows of theoretical pixels corresponding to a to-be-displayed image, wherein each theoretical pixel includes a plurality of theoretical sub-pixels, and each actual pixel corresponds to at least two theoretical pixels; a calculation circuit configured to calculate grayscale data of each actual sub-pixel of each actual pixel. The calculation circuit includes: a determination sub-circuit configured to, for a target actual pixel, determine a rendering mode for calculating the grayscale data of each actual sub-pixel of the target actual pixel according to whether there is a specified detail feature in a pixel area where target theoretical pixels corresponding to the target actual pixel are located, wherein when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed.

In a third aspect, one embodiment of the present disclosure provides a display device including: a processor, a memory, a computer program stored on the memory and executable on the processor, and a plurality of rows of actual pixels. Each actual pixel includes a plurality of actual sub-pixels, and starting positions of the actual sub-pixels in odd-numbered and even-numbered rows are staggered by a distance of half of an actual sub-pixel. The computer program is executed by the processor to, determine a plurality of rows of theoretical pixels corresponding to a to-be-displayed image, wherein each theoretical pixel includes a plurality of theoretical sub-pixels, and each actual pixel corresponds to at least two theoretical pixels; calculate grayscale data of each actual sub-pixel of each actual pixel. When calculating grayscale data of each actual sub-pixel of each actual pixel, the processor is configured to: for a target actual pixel, determine a rendering mode for calculating the grayscale data of each actual sub-pixel of the target actual pixel according to whether there is a specified detail feature in a pixel area where target theoretical pixels corresponding to the target actual pixel are located, wherein when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed.

BRIEF DESCRIPTION OF THE DRAWINGS

By reading the detailed description of optional embodiments below, various other advantages and benefits will become clear to those of ordinary skill in the art. The drawings are only for the purpose of showing the optional embodiments, and are not considered as limitations to the present disclosure. Throughout the drawings, the same reference symbols are used to denote the same parts.

DETAILED DESCRIPTION

The technical solutions in the embodiments of the present disclosure will be described hereinafter in a clear and complete manner in conjunction with the drawings in the embodiments of the present disclosure. Obviously, the following embodiments are merely a part of, rather than all of, the embodiments of the present disclosure, and based on these embodiments, a person skilled in the art may obtain the other embodiments, which also fall within the scope of the present disclosure.

When a pixel array with a BV3 structure is used for displaying an image, multiple rows of theoretical pixels corresponding a to-be-processed image are usually first determined. Each theoretical pixel includes multiple theoretical sub-pixels. Each actual pixel corresponds to at least two theoretical pixels. Then, grayscale values of actual pixels are calculated. Specifically, the gray-scale value of the actual sub-pixel is obtained by weighted addition of gray-scale values of a same-color theoretical sub-pixel corresponding to the actual sub-pixel of the actual pixel, an adjacent theoretical sub-pixel of the same-color theoretical sub-pixel, and a virtual sub-pixel between the same-color theoretical sub-pixel and the adjacent theoretical sub-pixel.

However, for some images with obvious detailed features, such as bright lines on a dark background, bright points on a dark background, checkerboard and other detailed features, the above image processing method cannot effectively render, which will result in loss of detailed features in the image.

In view of this, embodiments of the present disclosure provide an image processing method and a display device, which can solve the problem that the image processing method for a display device with a BV3 pixel structure in the related art may cause loss of detailed features in the image.

Figure 1:
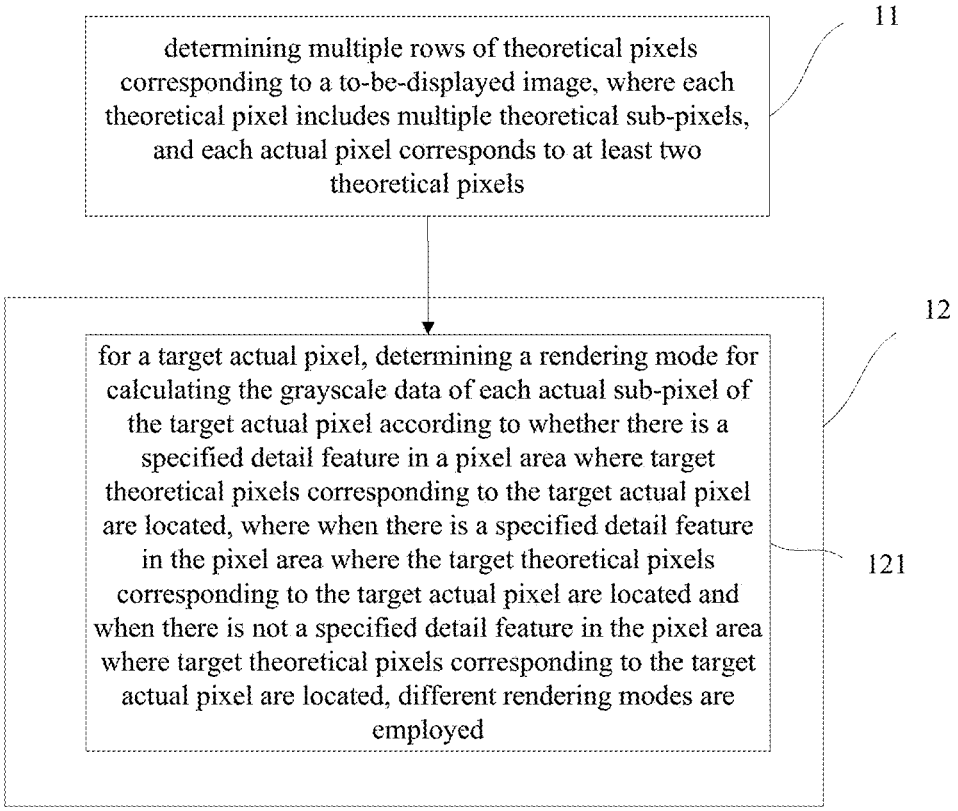
FIG. 1 is a schematic flowchart of an image processing method according to an embodiment of the present disclosure.

Referring to FIG. 1, FIG. 1 is a schematic flowchart of an image processing method according to an embodiment of the present disclosure. The image processing method is applied to a display device. The display device includes multiple rows of actual pixels. Each actual pixel includes multiple actual sub-pixels. Starting positions of the actual sub-pixels in odd-numbered and even-numbered rows are staggered by a distance of half of an actual sub-pixel. The image processing method includes:

Step 11: determining multiple rows of theoretical pixels corresponding to a to-be-displayed image, where each theoretical pixel includes multiple theoretical sub-pixels, and each actual pixel corresponds to at least two theoretical pixels.

Figure 2:
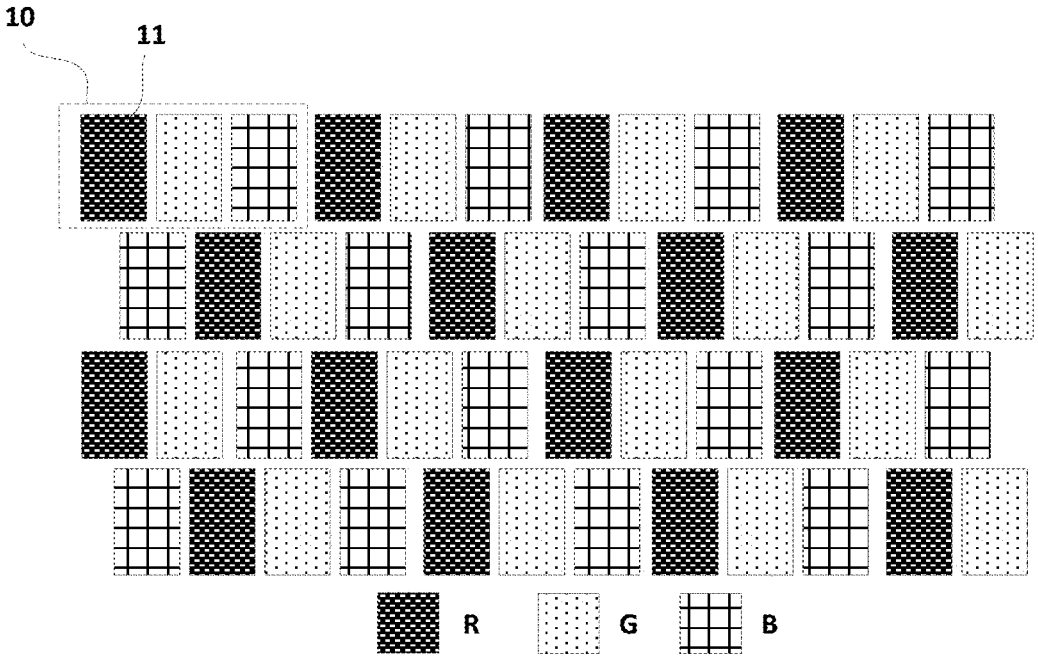
FIG. 2 is a schematic diagram of a pixel structure of a display device according to an embodiment of the present disclosure.

Referring to FIG. 2, FIG. 2 is a schematic diagram of a pixel structure of a display device according to an embodiment of the present disclosure. In the embodiment shown in FIG. 2, the display device includes multiple rows of actual pixels 10. Each actual pixel 10 includes multiple actual sub-pixels 11. Compared with the actual sub-pixels of odd-numbered rows, the starting position of the actual sub-pixels of even-numbered rows is shifted to the right by a distance of half an actual sub-pixel. Of course, in some other embodiments of the present disclosure, the starting position of the actual sub-pixels of even-numbered rows is shifted to the left by a distance of half an actual sub-pixel. This type of pixel structure may be referred to as a BV3 pixel structure. In the embodiment shown in FIG. 2, each actual pixel 10 includes a red (R) sub-pixel, a green (G) sub-pixel, and a blue (B) sub-pixel. Of course, it should be noted that in some other embodiments of the present disclosure, colors of the actual sub-pixels are not limited to red, green, and blue, and the number of colors is not limited to three.

Figure 3:
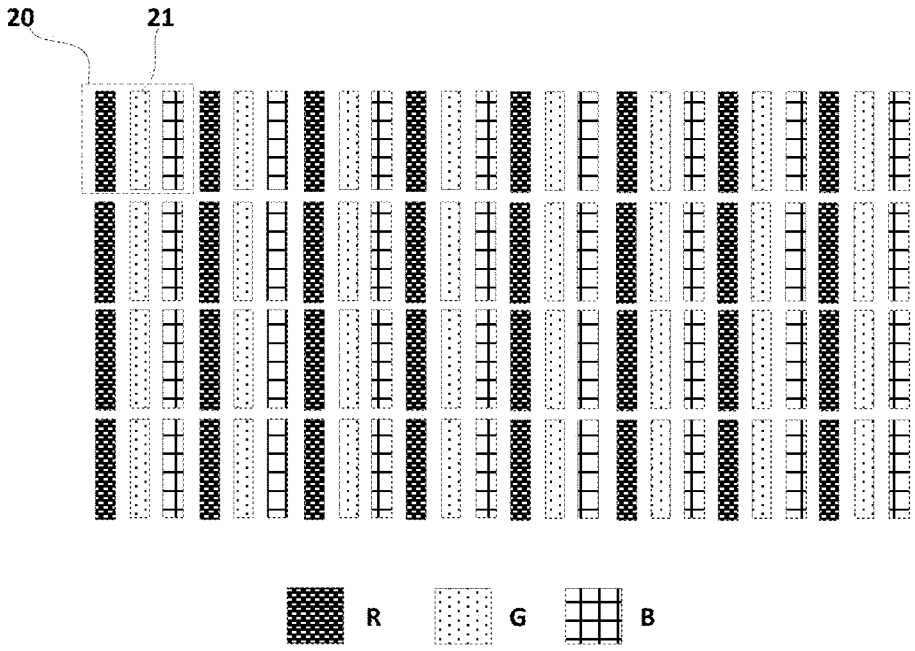
FIG. 3 is a schematic diagram of an arrangement of theoretical pixels corresponding to a to-be-displayed image according to an embodiment of the present disclosure.

Referring to FIG. 3, FIG. 3 is a schematic diagram of an arrangement of theoretical pixels corresponding to a to-be-displayed image according to an embodiment of the present disclosure. In one embodiment of the present disclosure, the to-be-displayed image corresponds to multiple rows of theoretical pixels 20. Each theoretical pixel includes multiple theoretical sub-pixels 21. The number of rows of theoretical pixels 20 is the same as the number of rows of actual pixels, and one row of theoretical pixels corresponds to one row of actual pixels. The number of theoretical sub-pixels in each theoretical pixel 20 is the same as the number of actual sub-pixels in each actual pixel, and colors also correspond to each other. In the embodiment shown in FIG. 3, each theoretical pixel 20 includes a red (R) sub-pixel, a green (G) sub-pixel, and a blue (B) sub-pixel. A length of the theoretical sub-pixel is the same as a length of the actual sub-pixel, but their widths are different.

Figure 4:
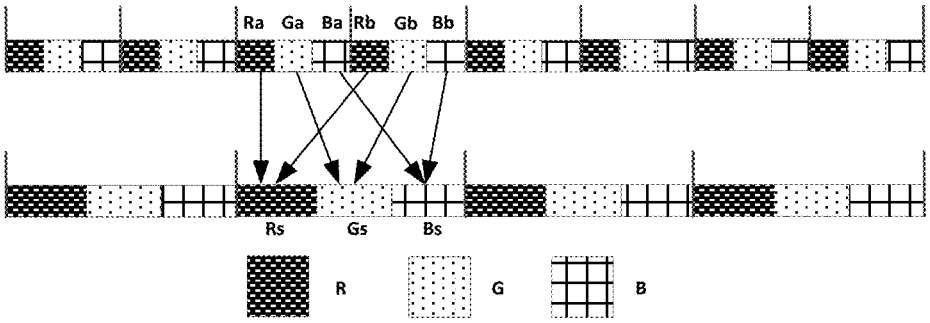
FIG. 4 is a schematic diagram of an average-weight mapping method according to an embodiment of the present disclosure.
Figure 5:
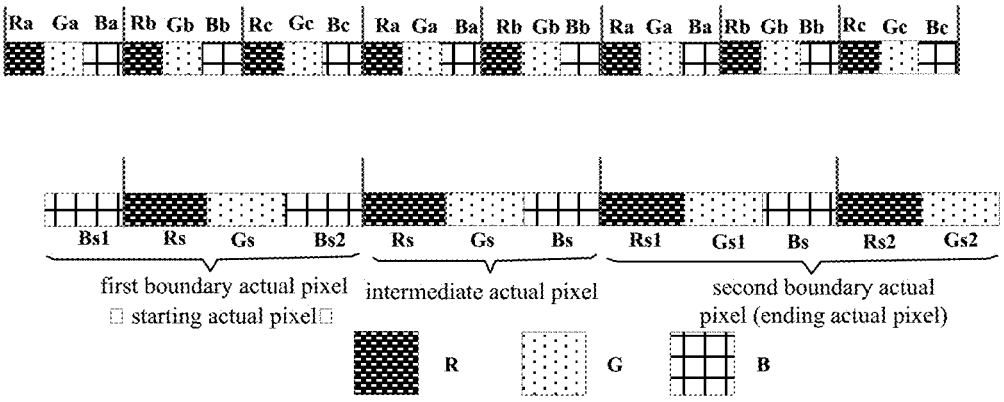
FIG. 5 is another schematic diagram of an average-weight mapping method according to an embodiment of the present disclosure.

The correspondence between the actual pixels and the theoretical pixels will be explained by taking the display device in FIG. 2 as an example. It should be noted that due to different arrangements of actual pixels in odd-numbered and even-numbered rows, the corresponding modes are different. Referring to FIG. 4, each actual pixel of the odd-numbered row corresponds to two theoretical pixels, respectively. Referring to FIG. 5, the actual pixels in the even-numbered rows include two boundary actual sub-pixels and multiple intermediate actual sub-pixels. An actual sub-pixel at the left boundary and an adjacent complete actual pixel form a starting actual pixel (also referred as a first boundary actual pixel). The starting actual pixel corresponds to three theoretical pixels. Two actual sub-pixels at the right boundary and an adjacent complete actual pixel form an ending actual pixel (also referred as a second boundary actual pixel). The ending actual pixel corresponds to three theoretical pixels. Each of the remaining intermediate actual pixels corresponds to two theoretical pixels.

Step 12: calculating grayscale data of each actual sub-pixel of each actual pixel.

The calculating grayscale data of each actual sub-pixel of each actual pixel, includes:

Step 121: for a target actual pixel, determining a rendering mode for calculating the grayscale data of each actual sub-pixel of the target actual pixel according to whether there is a specified detail feature in a pixel area where target theoretical pixels corresponding to the target actual pixel are located, where when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed.

In one embodiment of the present disclosure, when the display device with a BV3 pixel structure displays an image, if there is a specified detail feature in the pixel area where target theoretical pixels corresponding to the target actual pixel are located, a rendering mode corresponding to the specified detail feature is employed to calculate the grayscale data of each actual sub-pixel of the target actual pixel, thereby avoiding the loss of specified detail features and then improving the display effect.

The following first describes a rendering mode employed when there is not a specified detail feature in the pixel area where target theoretical pixels corresponding to the target actual pixel are located.

In one embodiment of the present disclosure, optionally, for a target actual pixel, determining a rendering mode for calculating the grayscale data of each actual sub-pixel of the target actual pixel according to whether there is a specified detail feature in a pixel area where target theoretical pixels corresponding to the target actual pixel are located, includes:

when there is not a specified detail feature in the pixel area where target theoretical pixels are located, for a target actual sub-pixel of the target actual pixel, obtaining a weighted average of grayscale data of the same-color theoretical sub-pixels in the target theoretical pixels;

determining grayscale data of the target actual sub-pixel according to the weighted average of grayscale data of the same-color theoretical sub-pixels.

Examples will be described below.

In the BV3 pixel structure, arrangements of the actual sub-pixels in the odd-numbered and even-numbered rows are different (there is an offset of half of an actual sub-pixels in the even rows), thus when performing image rendering, the odd-numbered row and even-numbered row need to be processed separately.

(1) In one row of the odd-numbered row and the even-numbered row of actual pixels, each actual pixel corresponds to two theoretical pixels (referring to FIG. 4); and each of the actual pixel and the theoretical pixels includes a first-color sub-pixel, a second-color sub-pixel and a third-color sub-pixel; grayscale data of the first-color sub-pixel, the second-color sub-pixel and the third-color sub-pixel of the actual pixels are calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

Where $\partial 1+\beta 1=1$, Bs represents grayscale data of the first-color sub-pixel of the actual pixel, Rs represents grayscale data of the second-color sub-pixel of the actual pixel, and Gs represents grayscale data of the third-color sub-pixel of the actual pixel, Ba and Bb represent grayscale data of first-color sub-pixels of the two target theoretical pixels corresponding to the actual pixel, Ra and Rb represent grayscale data of second-color sub-pixels of the two target theoretical pixels corresponding to the actual pixel, and Ga and Gb represent grayscale data of third-color sub-pixels of the two target theoretical pixels corresponding to the actual pixel.

Taking the embodiment shown in FIG. 4 as an example, in the embodiment shown in FIG. 4, for the actual pixels in the odd-numbered row, each actual pixel corresponds to two theoretical pixels; each of the actual pixel and the theoretical pixels includes a blue sub-pixel, a red sub-pixel and a green sub-pixel, grayscale data of the blue sub-pixel, the red sub-pixel and the green sub-pixel of the actual pixels are calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

where ∂1+β1=1, Bs represents grayscale data of the blue color sub-pixel of the actual pixel, Rs represents grayscale data of the red color sub-pixel of the actual pixel, and Gs represents grayscale data of the green color sub-pixel of the actual pixel, Ba and Bb represent grayscale data of blue color sub-pixels of the two target theoretical pixels corresponding to the actual pixel, Ra and Rb represent grayscale data of red color sub-pixels of the two target theoretical pixels corresponding to the actual pixel, and Ga and Gb represent grayscale data of green color sub-pixels of the two target theoretical pixels corresponding to the actual pixel.

(2) In the other row of the odd-numbered row and the even-numbered row of actual pixels, two boundary actual sub-pixels and multiple intermediate actual sub-pixels are included; each of the two boundary actual sub-pixels corresponds to three theoretical pixels; each of the intermediate actual sub-pixels corresponds to two theoretical pixels (referring to FIG. 5);

(21) a first boundary actual pixel of the two boundary actual pixels includes two first-color sub-pixels, one second-color sub-pixel and one third-color sub-pixel; and grayscale data of each actual sub-pixel of the first boundary actual pixel is calculated as:

$$Bs1=((\partial 2*Ba+\beta 2*Bb+r2*Bc)*0.5);$$

$$Bs2=Bs1;$$

$$Rs=(\partial 2*Ra+\beta 2*Rb+r2*Rc);$$

$$Gs=(\partial 2*Ga+\beta 2*Gb+r2*Gc);$$

Where α2+β2+γ2=1, Bs1 and Bs2 represent grayscale data of the two first-color sub-pixels of the first boundary actual pixel, Rs represents grayscale data of the second-color sub-pixel of the first boundary actual pixel, Gs represents grayscale data of the third-color sub-pixel of the first boundary actual pixel; Ba, Bb and Bc represent grayscale data of the first-color sub-pixels of the three target theoretical pixels corresponding to the first boundary actual pixel, respectively; Ra, Rb and Rc represent grayscale data of the second-color sub-pixels of the three target theoretical pixels corresponding to the first boundary actual pixel, respectively; and Ga, Gb and Gc represent grayscale data of the third-color sub-pixels of the three target theoretical pixels corresponding to the first boundary actual pixel, respectively.

Taking the embodiment shown in FIG. 5 as an example, for the actual pixels in the even-numbered row, the first boundary actual pixel (i.e., the starting actual pixel) includes two blue sub-pixels, a red sub-pixel, and a green sub-pixel. The grayscale data of each actual sub-pixel of the starting actual pixel is calculated as:

$$Bs1=((\partial 2*Ba+\beta 2*Bb+r2*B\ c)*0.5);$$

$$Bs2=Bs1;$$

$$Rs=(\partial 2*Ra+\beta 2*Rb+r2*Rc);$$

$$Gs=(\partial 2*Ga+\beta 2*Gb+r2*Gc);$$

Where α2+β2+γ2=1, Bs1 and Bs2 represent grayscale data of the two blue sub-pixels of the starting actual pixel, Rs represents grayscale data of the red sub-pixel of the starting actual pixel, Gs represents grayscale data of the green sub-pixel of the starting actual pixel; Ba, Bb and Bc represent grayscale data of the blue sub-pixels of the three target theoretical pixels corresponding to the starting actual pixel, respectively; Ra, Rb and Rc represent grayscale data of the red sub-pixels of the three target theoretical pixels corresponding to the starting actual pixel, respectively; and Ga, Gb and Gc represent grayscale data of the green sub-pixels of the three target theoretical pixels corresponding to the starting actual pixel, respectively.

(22) a second boundary actual pixel (i.e., ending actual pixel) includes one first-color sub-pixel, two second-color sub-pixels and two third-color sub-pixels; and grayscale data of each actual sub-pixel of the second boundary actual pixel is calculated as:

$$Bs=((\partial 3*Ba+\beta 3*Bb+r3*Bc));$$

$$Rs1=((\partial 3*Ra+\beta 3*Rb+r3*Rc)*0.5);$$

$$Rs2=Rs1;$$

$$Gs1=((\partial 3*Ga+\beta 3*Gb+r3*Gc)*0.5);$$

$$Gs2=Gs1;$$

Where ∂3ββ3+r3=1, Bs represents grayscale data of the first-color sub-pixel of the second boundary actual pixel; Rs1 and Rs2 represent grayscale data of the two second-color sub-pixels of the second boundary actual pixel; Gs1 and Gs2 represent grayscale data of the two third-color sub-pixels of the second boundary actual pixel; Ba, Bb and Bc represent grayscale data of first-color sub-pixels of three target theoretical pixels corresponding to the second boundary actual pixel, Ra, Rb and Rc represent grayscale data of second-color sub-pixels of three target theoretical pixels corresponding to the second boundary actual pixel; and Ga, Gb and Gc represent grayscale data of third-color sub-pixels of three target theoretical pixels corresponding to the second boundary actual pixel.

Taking the embodiment shown in FIG. 5 as an example, for the actual pixels in the even-numbered row, the second boundary actual pixel (i.e., the ending actual pixel) includes one blue sub-pixel, two red sub-pixels, and two green sub-pixels. The grayscale data of each actual sub-pixel of the ending actual pixel is calculated as:

$$Bs=((\partial 3*Ba+\beta 3*Bb+r3*Bc));$$

$$Rs1=((\partial 3*Ra+\beta 3*Rb+r3*Rc)*0.5);$$

$$Rs2=Rs1;$$

$$Gs1=((\partial 3*Ga+\beta 3*Gb+r3*Gc)*0.5);$$

$$Gs2=Gs1;$$

Where ∂3+β3+r3=1, Bs represents grayscale data of the blue sub-pixel of the ending actual pixel; Rs1 and Rs2 represent grayscale data of the two red sub-pixels of the ending actual pixel; Gs1 and Gs2 represent grayscale data of the two green sub-pixels of the ending actual pixel; Ba, Bb and Bc represent grayscale data of blue sub-pixels of three target theoretical pixels corresponding to the ending actual pixel, Ra, Rb and Rc represent grayscale data of red sub-pixels of three target theoretical pixels corresponding to the ending actual pixel; and Ga, Gb and Gc represent grayscale data of green sub-pixels of three target theoretical pixels corresponding to the ending actual pixel.

(23) grayscale data of each actual sub-pixel of the intermediate actual pixel is calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

Where $\partial 1+\beta 1=1$, Bs represents grayscale data of a first-color sub-pixel of the intermediate actual pixel; Rs represents grayscale data of a second-color sub-pixel of the intermediate actual pixel; Gs represents grayscale data of a third-color sub-pixel of the intermediate actual pixel; Ba and Bb represent grayscale data of first-color sub-pixels of two target theoretical pixels corresponding to the intermediate actual pixels, respectively; Ra and Rb represent grayscale data of second-color sub-pixels of two target theoretical pixels corresponding to the intermediate actual pixels, respectively; Ga and Gb represent grayscale data of third-color sub-pixels of two target theoretical pixels corresponding to the intermediate actual pixels, respectively.

Taking the embodiment shown in FIG. 5 as an example, for the actual pixels in the even-numbered row, grayscale data of each actual sub-pixel of the intermediate actual pixel is calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

Where $\partial 1+\beta 1=1$, Bs represents grayscale data of a blue sub-pixel of the intermediate actual pixel; Rs represents grayscale data of a red sub-pixel of the intermediate actual pixel; Gs represents grayscale data of a green sub-pixel of the intermediate actual pixel; Ba and Bb represent grayscale data of blue sub-pixels of two target theoretical pixels corresponding to the intermediate actual pixels, respectively; Ra and Rb represent grayscale data of red sub-pixels of two target theoretical pixels corresponding to the intermediate actual pixels, respectively; Ga and Gb represent grayscale data of green sub-pixels of two target theoretical pixels corresponding to the intermediate actual pixels, respectively.

By employing the weighting method in the above embodiment, for some images including the specified detail features, such as the images containing fonts, the problem of color deviation of fonts can be solved.

Of course, in some other embodiments of the present disclosure, when there is not a specified detail feature in the pixel area where target theoretical pixels are located, other rendering modes, such as the rendering mode mentioned in the background art, may also be employed.

In one embodiment of the present disclosure, optionally, the specified detail feature includes at least one of the following:

oblique line;

vertical line;

point;

checkerboard.

In one embodiment of the present disclosure, for the target actual pixel, before determining a rendering mode for calculating the grayscale data of each actual sub-pixel of the target actual pixel according to whether there is a specified detail feature in a pixel area where target theoretical pixels corresponding to the target actual pixel are located, the method further includes:

Step 1201: obtaining a pixel window corresponding to the target theoretical pixel; where the pixel window includes n rows and m columns of the theoretical pixels, n and m are positive integers. The target theoretical pixel is located in the pixel window. Optionally, the target theoretical pixel is located in the middle of the pixel window. It is supposed that n=3 and m=7, i.e., the pixel window includes 3 rows and 7 columns of theoretical pixel units, and one target theoretical pixel unit may be located in the middle of the second row.

Step 1202: determining whether there is a specified detail feature in the pixel window.

Figure 6:
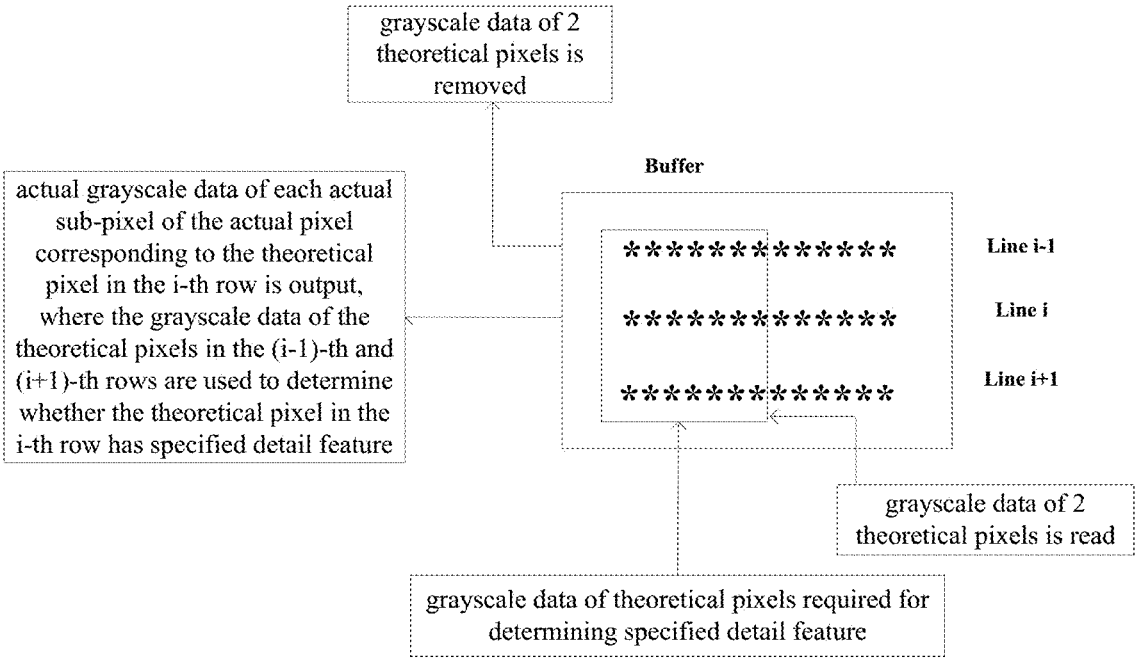
FIG. 6 is a schematic diagram of a pixel window according to an embodiment of the present disclosure.

For example, referring to FIG. 6, in the embodiment shown in FIG. 6, n is equal to 3, m is equal to 7, that is, the pixel window is 3 rows and 7 columns of theoretical pixels. For a target actual pixel, grayscale data of 2 theoretical pixels is read into a buffer. It is assumed that target theoretical pixels are located in an i-th row, and grayscale data of the 3 rows and 7 columns in the pixel window is grayscale data of the theoretical pixels in the i-th row, a (i−1)-th row and a (i+1)-th row. The grayscale data of the theoretical pixels in the pixel window with 3 rows and 7 columns is grayscale data of the theoretical pixels required for determining the specified detail feature, and not all of the grayscale data of the theoretical pixels in the pixel window participate in calculation of the grayscale data of the target actual pixel, and only the grayscale data of 2 target theoretical pixels participates in the calculation of the grayscale data of the target actual pixel. The output is grayscale data of each actual sub-pixel of a target actual pixel in the i-th row. After the output is completed, the grayscale data of the 2 target theoretical pixels is removed from the buffer, and then grayscale data of new 2 theoretical pixels are read into the buffer to calculate grayscale data of each actual sub-pixel of a next target actual pixel. If the target theoretical pixel is located at the boundary and there is no theoretical pixel around it for determining the specified detail feature, not available data may be filled in by means of zero padding. For example, for the first row of theoretical pixels, i.e., i=1, grayscale data of an actual pixel corresponding to the theoretical pixel in the first row may be calculated by adding a row of zeros above the first row of theoretical pixels. For the last row of theoretical pixels, grayscale data of an actual pixel corresponding to the theoretical pixel in the last row may be calculated by adding a row of zeros below the last row of theoretical pixels.

The values of n and m may be determined according to the number of minimum theoretical pixels required by the specify detail feature, thereby reducing the consumption of resources. When the image processing method of the embodiment of the present disclosure is implemented by hardware, occupied hardware resources can be reduced as much as possible.

The following describes how to determine whether there is a specified detail feature in the pixel window.

In one embodiment of the present disclosure, optionally, determining whether the to-be-displayed image has a specified detail feature in a pixel window, includes:

Step 12021: marking a type of each theoretical pixel in the pixel window;

Step 12022: according to the type of each theoretical pixel in the pixel window and an arrangement mode, as well as a pre-stored arrangement mode of theoretical pixels corresponding to the specified detail feature, determining whether the specified detail feature is in the pixel window.

In some embodiments of the present disclosure, optionally, the marking a type of each theoretical pixel in the pixel window, includes:

judging whether each theoretical pixel in the pixel window is of a preset pixel type, where the pixel type includes at least one of the following:

a first-type pixel, where grayscale data of each theoretical sub-pixel in the first-type pixel is less than a first threshold;

a second-type pixel, where grayscale data of each theoretical sub-pixel in the second-type pixel is greater than a second threshold;

a third-type pixel, where grayscale data of each theoretical sub-pixel in the third-type pixel is greater than a third threshold;

a fourth-type pixel, where grayscale data of a first-color sub-pixel in the fourth-type pixel is greater than the second threshold, and the fourth-type pixel is a theoretical pixel of odd-numbered row and odd-numbered column or a theoretical pixel of even-numbered row and even-numbered column;

a fifth-type pixel, where grayscale data of a second-color sub-pixel or a third-color sub-pixel of the fifth-type pixel is greater than the second threshold, and the fifth-type pixel is a theoretical pixel of an odd-numbered row and even-numbered column or a theoretical pixel of an even-numbered odd-numbered column theoretical pixel.

When the theoretical pixels include three theoretical sub-pixels including a red sub-pixel, a green sub-pixel and a blue sub-pixel, the first-color sub-pixel may be a blue sub-pixel, the second-color sub-pixel may be a red sub-pixel, and the third-color sub-pixel may be a green sub-pixel.

When the theoretical pixels include three theoretical sub-pixels including a red sub-pixel, a green sub-pixel and a blue sub-pixel, each of the first-type pixel, the second-type pixel, the third-type pixel, the fourth-type pixel and the fifth-type pixel meets the following conditions:

the first-type pixel meets that (GLR(i,j)<Critical_B)&&(GLG(i,j)<Critical_B)&&(GLB(i,j)<Critical_B); the first-type pixel may also be referred as a black pixel;

the second-type pixel meets that (GLR(i,j)>Critical_C||(GLG(i,j)>Critical C||(GLB(i,j)>Critical_C); the second-type pixel may also be referred as a white pixel;

the third-type pixel meets that (GLR(i,j)>Critical_W)&&(GLG(i,j)>Critical_W)&&(GLB(i,j)>Critical_W); the second-type pixel may also be referred as a color pixel;

the fourth-type pixel meets that (GLB(i,j)>Critical_C)&&{(i,j)=(odd-numbered, odd-numbered)||(i,j)=(even, even)}; the fourth-type pixel may also be referred as a blue pixel;

the fifth-type pixel meets that {(GLR(i,j)>Critical_C)||(GLG(i,j)>Critical_C)} && {(i,j)=(odd-numbered, even)||(i,j)=(Ev en,odd-numbered)}; the fifth-type pixel may also be referred as a R&G pixel;

where i, j represent a theoretical pixel of an i-th row and a j-th column corresponding to the to-be-displayed image; GLR (i,j) represents grayscale data of a red sub-pixel in the theoretical pixel of the i-th row and the j-th column; GLG (i,j) represents grayscale data of a green sub-pixel in the theoretical pixel of the i-th row and the j-th column; GLB (i,j) represents grayscale data of a blue sub-pixel in the theoretical pixel of the i-th row and the j-th column; Critical_B represents a first threshold; Critical_C represents a second threshold; Critical_W represents a third threshold; || represents OR in logic operation, && represents AND in logic operation.

The first threshold, the second threshold and the third threshold may be set according to needs. For example, Critical_B=20, Critical_C=20, and Critical_W=200.

In one embodiment of the present disclosure, the pixel type to be judged may be determined according to the specified detail feature to be processed. For example, the pixel types to be judged may include: first-type pixel and fourth-type pixel, that is, judging whether theoretical pixels in the pixel window include first-type pixel and fourth-type pixel.

In some embodiments of the present disclosure, the pixel types to be judged may include all of the above pixel types. For example, in some embodiments, it may be first judged whether the theoretical pixel is one of the first-type pixel, the second-type pixel, and the third-type pixel, and then whether the theoretical pixel is one of the fourth-type pixel and the fifth-type pixel.

Figure 7:
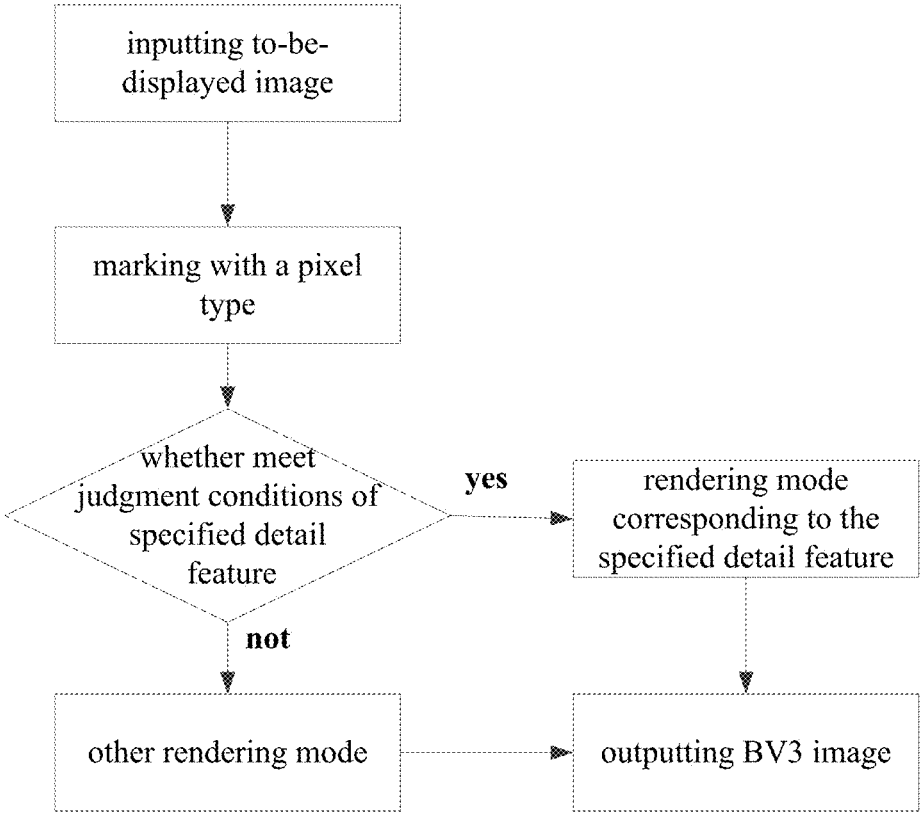
FIG. 7 is another schematic flowchart of an image processing method according to an embodiment of the present disclosure.

In some embodiments of the present disclosure, optionally, referring to FIG. 7, an input to-be-displayed image (also referred to as real) may first be marked with a pixel type, and then it is judged whether the to-be-displayed image meets conditions of a specified detail feature according to the pixel type. If the to-be-displayed image meets the conditions of the specified detail feature, a rendering mode corresponding to the specified detail feature is performed; otherwise, the above weighting mode is performed, and finally an image that conforms to the BV3 pixel structure is output.

In the above embodiment, it is mentioned that the specified detail features include an oblique line, a vertical line, a point and a checkerboard. The following describes rendering modes of images with the above specified detail features.

Vertical Oblique Line Composed of Fourth-Type Pixels

One embodiment of the present disclosure takes 1-pixel oblique line composed of the fourth-type pixels as an example. The so-called 1-pixel oblique line means that the oblique line occupies only one theoretical pixel in each row. The color displayed by the fourth-type pixel herein may be blue, and of course, may also be other colors, which are specifically related to the second threshold Critical_C. The same goes for the follow-on. In the following examples, blue is used as an example.

Figure 8:
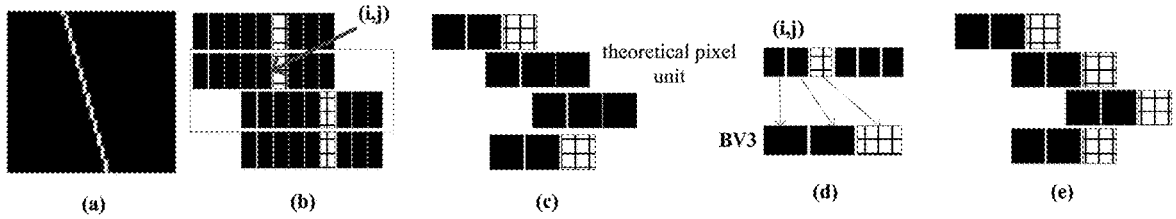
FIG. 8 is a schematic diagram of a mapping mode of a vertical oblique line according to an embodiment of the present disclosure.

Referring to (a) and (b) in FIG. 8, when a to-be-displayed image includes 1-pixel vertical oblique line, the oblique line is zoomed-in and then it can be found that the oblique line is mainly composed of small vertical lines. If the oblique line is treated as a pure vertical line, grayscale data on some blue sub-pixels will be lost, as shown in (c) in FIG. 8, which will cause problems such as broken line and weak when the oblique line is displayed.

Figure 9:
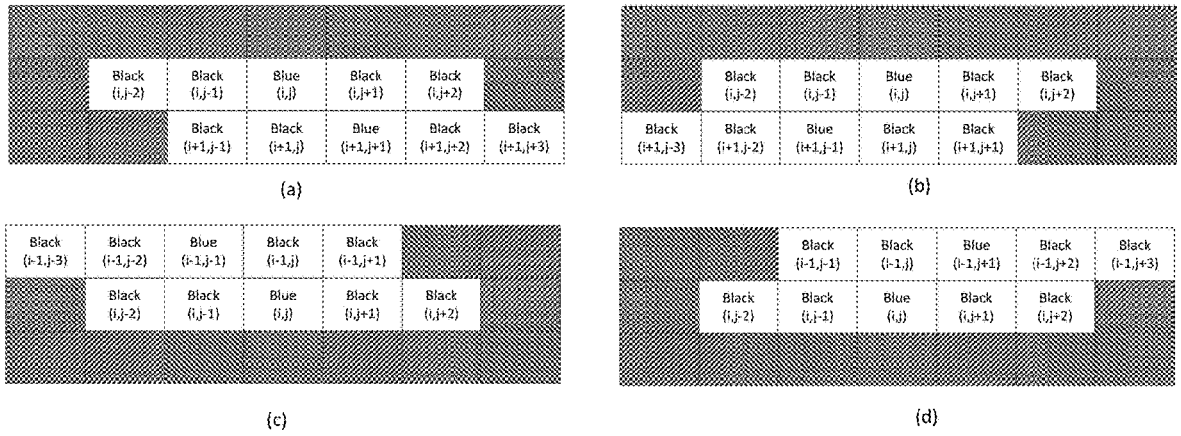
FIG. 9 is a schematic diagram of a pixel arrangement of a vertical oblique line according to an embodiment of the present disclosure.

In one embodiment of the present disclosure, referring to FIG. 9, when the theoretical pixels in the pixel window meet the following arrangement mode, it is judged that there is a vertical oblique line in the pixel window:

the pixel window includes two rows of theoretical pixels for judgement, each of the two rows of theoretical pixels for judgement includes five consecutive theoretical pixels for judgement, and the two rows of theoretical pixels for judgement are staggered by one theoretical pixel; among the five consecutive theoretical pixels for judgement, one of the theoretical pixels in the middle is the fourth-type pixel, and four of the theoretical pixels at two sides are the first-type pixels.

The calculating grayscale data of each actual sub-pixel of each actual pixel further includes:

mapping grayscale data of each theoretical sub-pixel of the target theoretical pixel marked as the fourth-type pixel to each same-color actual sub-pixel of the target actual pixel.

Referring to (b) and (d) in FIG. 8, (i,j) in (b) and (d) in FIG. 8 represents the target theoretical pixel. When performing image rendering, grayscale data of a first theoretical sub-pixel of a target theoretical pixel marked as the fourth-type pixel is mapped to a first same-color actual sub-pixel of the target actual pixel; grayscale data of a second theoretical sub-pixel of the target theoretical pixel is mapped to a second same-color actual sub-pixel of the target actual pixel; and grayscale data of a third theoretical sub-pixel of the target theoretical pixel is mapped to a third same-color actual sub-pixel of the target actual pixel. This can avoid the loss of grayscale data of the blue sub-pixels and obtain a continuous oblique line as shown in (e) of FIG. 8. The one-way arrow shown in the mapping method in FIG. 8 indicates that the grayscale of each theoretical sub-pixel of the corresponding theoretical pixel is directly mapped to the same-color actual sub-pixel of the corresponding target actual pixel. The same goes for the follow-on.

Referring to FIG. 9, FIG. 9 is a schematic diagram of an arrangement mode of theoretical pixels of a vertical oblique line which is composed of the fourth-type pixels according to an embodiment of the present disclosure. As long as the theoretical pixels in the pixel window meet any of arrangement modes in FIG. 9, it is judged that there is a vertical oblique line composed of the fourth-type pixels in the pixel window. In FIG. 9, black refers to the first-type pixel, blue refers to the fourth-type pixel, i refers to a row number, and j refers to a column number. The pixel window in FIG. 9 is a 3*7 pixel window, and gray grids represent theoretical pixels in the pixel window that do not contribute to the judgement of the oblique line. The same is true in the subsequent drawings.

Vertical Oblique Line Composed of Fifth-Type Pixels

One embodiment of the present disclosure takes 1-pixel vertical oblique line composed of the fifth-type pixels as an example. The so-called 1-pixel oblique line means that the oblique line occupies only one theoretical pixel in each row. In one embodiment of the present disclosure, the vertical oblique line may be referred to as a red & green oblique line. It should be noted that red & green does not only include red and green, but also includes a color formed by mixing red and green subpixels of any grayscale.

Figure 10:
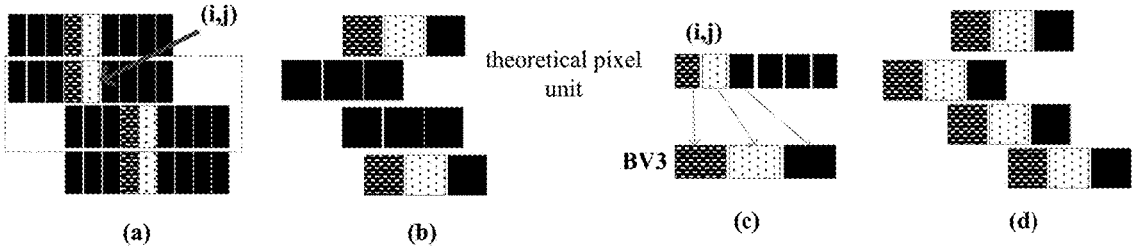
FIG. 10 is another schematic diagram of a mapping mode of a vertical oblique line according to an embodiment of the present disclosure.

Referring to (a) in FIG. 10, when a to-be-displayed image includes 1-pixel vertical oblique line, the oblique line is zoomed-in and then it can be found that the oblique line is mainly composed of small vertical lines. If the oblique line is treated as a pure vertical line, grayscale data on some red sub-pixels and some green sub-pixels will be lost, as shown in (b) in FIG. 10, which will cause problems such as broken line and weak when the oblique line is displayed.

Figure 11:
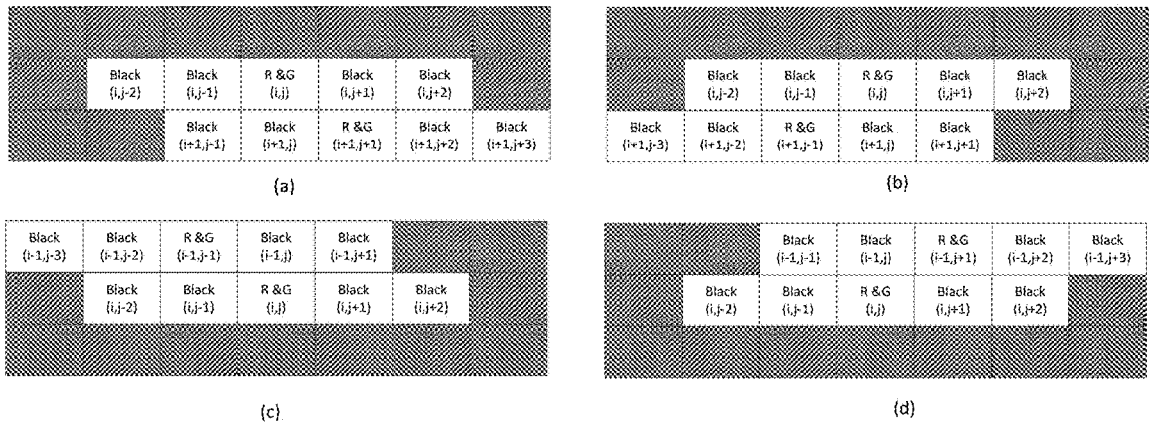
FIG. 11 is another schematic diagram of a pixel arrangement of a vertical oblique line according to an embodiment of the present disclosure.

In one embodiment of the present disclosure, referring to FIG. 11, when the theoretical pixels in the pixel window meet the following arrangement mode, it is judged that there is a vertical oblique line in the pixel window:

the pixel window includes two rows of theoretical pixels for judgement, each of the two rows of theoretical pixels for judgement includes five consecutive theoretical pixels for judgement, and the two rows of theoretical pixels for judgement are staggered by one theoretical pixel; among the five consecutive theoretical pixels for judgement, one of the theoretical pixels in the middle is the fifth-type pixel, and four of the theoretical pixels at two sides are the first-type pixels.

The calculating grayscale data of each actual sub-pixel of each actual pixel further includes:

mapping grayscale data of each theoretical sub-pixel of the target theoretical pixel marked as the fifth-type pixel to each same-color actual sub-pixel of the target actual pixel.

Referring to (a) and (c) in FIG. 10, (i,j) in (a) and (c) in FIG. 10 represents the target theoretical pixel. When performing image rendering, grayscale data of a first theoretical sub-pixel of a target theoretical pixel marked as the fifth-type pixel is mapped to a first same-color actual sub-pixel of the target actual pixel; grayscale data of a second theoretical sub-pixel of the target theoretical pixel is mapped to a second same-color actual sub-pixel of the target actual pixel; and grayscale data of a third theoretical sub-pixel of the target theoretical pixel is mapped to a third same-color actual sub-pixel of the target actual pixel. This can avoid the loss of grayscale data of the red sub-pixels and the green sub-pixels, and obtain a continuous oblique line as shown in (d) of FIG. 10.

Referring to FIG. 11, FIG. 11 is a schematic diagram of an arrangement mode of theoretical pixels of a vertical oblique line which is composed of the fifth-type pixels according to an embodiment of the present disclosure. As long as the theoretical pixels in the pixel window meet any of arrangement modes in FIG. 11, it is judged that there is a vertical oblique line in the pixel window. In FIG. 11, black refers to the first-type pixel, R&G refers to the fifth-type pixel, i refers to a row number, and j refers to a column number. The pixel window in FIG. 11 is a 3*7 pixel window, and gray grids represent theoretical pixels in the pixel window that do not contribute to the judgement of the oblique line.

Transverse Oblique Line

Figure 12:
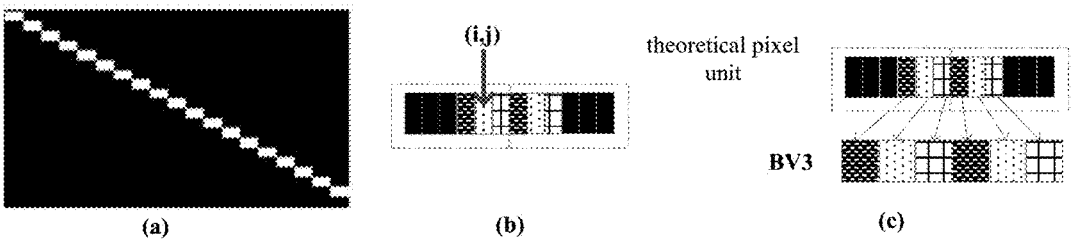
FIG. 12 is a schematic diagram of a mapping mode of a transverse oblique line according to an embodiment of the present disclosure.

Referring to (a) in FIG. 12, when a to-be-displayed image includes 1-pixel transverse oblique line, the oblique line is zoomed-in and then it can be found that the oblique line is mainly composed of small transverse lines. An arrangement mode of small transverse lines is shown in (b) in FIG. 12. In FIG. 12, a white oblique line is taken as an example, and the same goes for colored oblique lines. If the rendering is performed by the average weighting mode (i.e., second rendering mode), two theoretical pixels in two dotted boxes in (b) in FIG. 12 will be mapped to an actual pixel by weighting, respectively, and then grayscale will be reduced after rendering. Thus, when displaying, brightness of the oblique line is decreased, and the display becomes weak.

Figure 13:
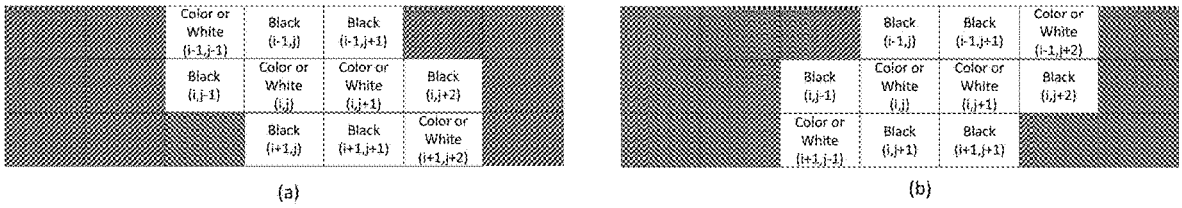
FIG. 13 is a schematic diagram of a pixel arrangement of a transverse oblique line according to an embodiment of the present disclosure.

In one embodiment of the present disclosure, referring to FIG. 13, when the theoretical pixels in the pixel window meet the following arrangement mode, it is judged that there is a transverse oblique line in the pixel window:

the pixel window includes three rows of theoretical pixels for judgement, each of the first row and the third row includes three consecutive theoretical pixels for judgement, the second row includes four consecutive theoretical pixels for judgement, the second row and one of the first row and the third row are staggered by one theoretical pixel; a first theoretical pixel for judgment in the first row, a last theoretical pixel for judgment in the third row, and the two theoretical pixels for judgment in the middle of the second row are the second-type pixels or the third-type pixels and the rest are the first-type pixels, or a last theoretical pixel for judgment in the first row, a first theoretical pixel for judgment in the third row, and the two theoretical pixels for judgment in the middle of the second row are the second-type pixels or the third-type pixels and the rest are the first-type pixels.

The calculating grayscale data of each actual sub-pixel of each actual pixel further includes:

mapping two target theoretical pixels marked as the second-type pixel or the third-type pixel in the second row to two consecutive actual pixels, respectively.

Referring to (b) and (c) in FIG. 12, (i,j) in (b) and (c) in FIG. 12 and the following theoretical pixels are the target theoretical pixels. When performing image rendering, grayscale data of two target theoretical pixels marked as second-type pixel or third-type pixel is mapped to two consecutive actual pixels, respectively. Grayscale data of a first theoretical sub-pixel of a first target theoretical pixel is mapped to a first same-color sub-pixel of a first actual pixel; grayscale data of a second theoretical sub-pixel is mapped to a second same-color actual sub-pixel of the first actual pixel; grayscale data of a third theoretical sub-pixel is mapped to a third same-color actual sub-pixel of the first actual pixel. Grayscale data of a first theoretical sub-pixel of a second theoretical pixel is mapped to a first same-color sub-pixel of a second actual pixel, grayscale data of a second theoretical sub-pixel is mapped to a second same-color sub-pixel of the second actual pixel, grayscale data of a third theoretical sub-pixel is mapped to a third same-color sub-pixel of the second actual pixel.

Referring to FIG. 13, FIG. 13 is a schematic diagram of an arrangement mode of theoretical pixels of a transverse oblique line according to an embodiment of the present disclosure. As long as the theoretical pixels in the pixel window meet any of arrangement modes in FIG. 13, it is judged that there is a transverse oblique line in the pixel window. In FIG. 13, black refers to the first-type pixel, Color refers to the third-type pixel, White refers to the second-type pixel, i refers to a row number, and j refers to a column number. The pixel window in FIG. 13 is a 3*7 pixel window, and gray grids represent theoretical pixels in the pixel window that do not contribute to the judgement of the oblique line.

(4) Vertical Line

Figure 14:
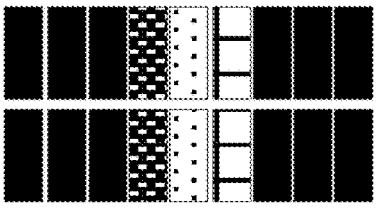
FIG. 14 is a schematic diagram of a vertical line according to an embodiment of the present disclosure.

Referring to FIG. 14, this embodiment of the present disclosure takes a 1-pixel white vertical line on a black background as an example for illustration, and the same goes for colored vertical lines. It should be noted that white is not only white of 255 grayscales, and is specifically related to the third threshold Critical_W. Similarly, black is not only black of 255 grayscale and is specifically related to the first threshold Critical_B.

Figure 17:
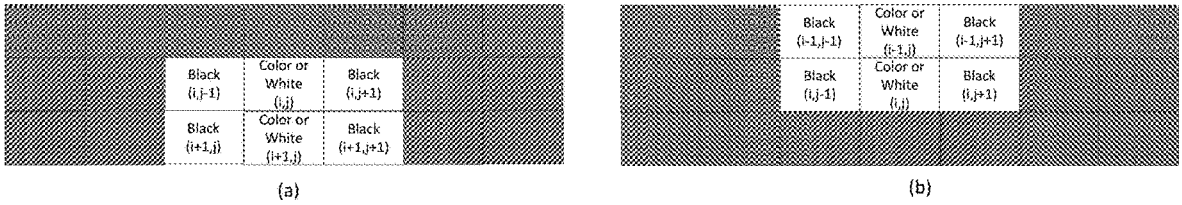
FIG. 17 is a schematic diagram of a pixel arrangement of a vertical line according to an embodiment of the present disclosure.

In one embodiment of the present disclosure, referring to FIG. 17, when the theoretical pixels in the pixel window meet the following arrangement mode, it is judged that there is a vertical line graphic in the pixel window:

the pixel window includes two rows of theoretical pixels for judgement, each row includes three consecutive theoretical pixels for judgement; the theoretical pixel in the middle of each row is the second-type pixel or the third-type pixel, and the rest are the first-type pixels.

The calculating grayscale data of each actual sub-pixel of each actual pixel further includes:

when a target theoretical pixel marked as the second-type pixel or the third-type pixel is located in odd-numbered row and odd-numbered column, or even-numbered row and even-numbered column, mapping a first theoretical sub-pixel and a second theoretical sub-pixel of the target theoretical pixel to a first actual sub-pixel and a second actual sub-pixel of a target actual pixel, respectively; mapping a last theoretical sub-pixel of a target theoretical pixel marked as the first-type pixel to a third actual sub-pixel of the target actual pixel;

when a target theoretical pixel marked as the second-type pixel or the third-type pixel is located in odd-numbered row and even-numbered column, or even-numbered row and odd-numbered column, mapping a third theoretical sub-pixel of the target theoretical pixel marked as the second-type pixel or the third-type pixel to a third actual sub-pixel of the target actual pixel; mapping a first theoretical sub-pixel and a second theoretical sub-pixel of the target theoretical pixel marked as the first-type pixel to a first actual sub-pixel and a second actual sub-pixel of the target actual pixel, respectively.

Figure 15:
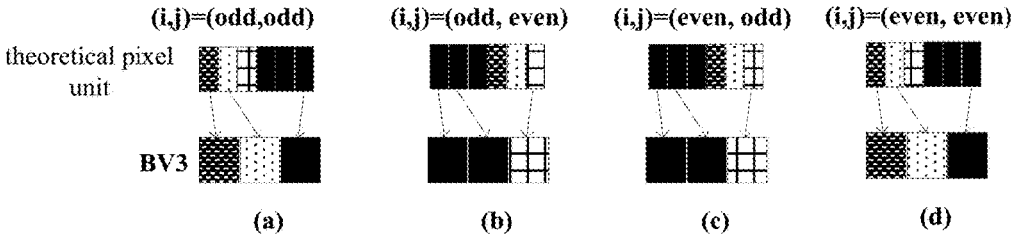
FIG. 15 is a schematic diagram of a mapping mode of a vertical line according to an embodiment of the present disclosure.
Figure 16:
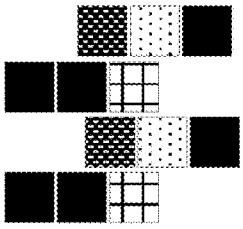
FIG. 16 is a schematic diagram of a vertical line displayed by a BV3 pixel structure according to an embodiment of the present disclosure.

Referring to FIG. 15, when the target theoretical pixel marked as the second-type pixel or the third-type pixel is located in odd-numbered row and odd-numbered column (as shown in (a) in FIG. 15) or even-numbered row and even-numbered column (as shown in (d) in FIG. 15), the first theoretical sub-pixel and the second theoretical sub-pixel of the target theoretical pixel marked as the second-type pixel or the third-type pixel are mapped to the first actual sub-pixel and the second actual sub-pixel of the target actual pixel, respectively; a last theoretical sub-pixel of the target theoretical pixel marked as the first-type pixel is mapped to a third actual sub-pixel of the target actual pixel. When the target theoretical pixel marked as the first-type pixel is located in odd-numbered row and even-numbered column (as shown in (c) in FIG. 15), or even-numbered row and odd-numbered column (as shown in (b) in FIG. 15), a third theoretical sub-pixel of the target theoretical pixel marked as the second-type pixel or the third-type pixel is mapped to a third actual sub-pixel of the target actual pixel; a first theoretical sub-pixel and a second theoretical sub-pixel of the target theoretical pixel marked as the first-type pixel are mapped to a first actual sub-pixel and a second actual sub-pixel of the target actual pixel, respectively. In this way, a vertical line shown in FIG. 16 can be obtained.

Referring to FIG. 17, FIG. 17 is a schematic diagram of an arrangement mode of theoretical pixels of a vertical line according to an embodiment of the present disclosure. As long as the theoretical pixels in the pixel window meet any of arrangement modes in FIG. 17, it is judged that there is a vertical line in the pixel window. In FIG. 17, black refers to the first-type pixel, color refers to the third-type pixel, white refers to the second-type pixel, i refers to a row number, and j refers to a column number. The pixel window in FIG. 17 is a 3*7 pixel window, and gray grids represent theoretical pixels in the pixel window that do not contribute to the judgement of the oblique line.

Point Composed of Second-Type Pixels or Third-Type Pixels

Figure 18:
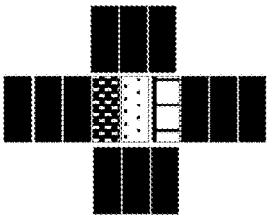
FIG. 18 is a schematic diagram of a point according to an embodiment of the present disclosure.

Referring to FIG. 18, this embodiment of the present disclosure takes a 1-pixel white point on a black background as an example for illustration, and the same goes for colored points. It should be noted that white is not only white of 255 grayscales, and is specifically related to the third threshold Critical_W. Similarly, black is not only black of 255 grayscale and is specifically related to the first threshold Critical_B.

Figure 20:
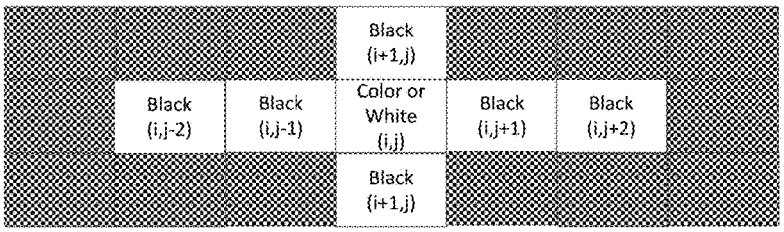
FIG. 20 is a schematic diagram of a pixel arrangement of a point according to an embodiment of the present disclosure.

In one embodiment of the present disclosure, referring to FIG. 20, when the theoretical pixels in the pixel window meet the following arrangement mode, it is judged that there is a point graphic in the pixel window:

within the pixel window, a target theoretical pixel corresponding to the target actual pixel is located in the second row of the pixel window; the target theoretical pixel is the second-type pixel or the third-type pixel; two theoretical pixels adjacent to a left side of the target theoretical pixel, two theoretical pixels adjacent to a right side of the target theoretical pixel, a theoretical pixel at an upper side, and a theoretical pixel at a lower side, are first-type pixels.

The calculating grayscale data of each actual sub-pixel of each actual pixel further includes:

mapping grayscale data of each theoretical sub-pixel of the target theoretical pixel marked as the second-type pixel or the third-type pixel to each same-color actual sub-pixel of the target actual pixel, respectively.

Figure 19:
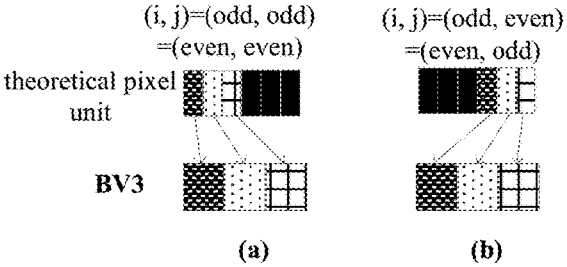
FIG. 19 is a schematic diagram of a mapping mode of a point according to an embodiment of the present disclosure.

Referring to FIG. 19, grayscale data of each theoretical sub-pixel of the target theoretical pixel marked as the second-type pixel or the third-type pixel is mapped to each same-color actual sub-pixel of the target actual pixel, respectively. The target theoretical pixel may be a theoretical sub-pixel in odd-numbered row and odd-numbered column, or a theoretical sub-pixel in even-numbered row and even-numbered column, i.e., the first target theoretical pixel corresponding to the target actual pixel. The target theoretical pixel may also be a theoretical sub-pixel in odd-numbered row and even-numbered column, or a theoretical sub-pixel in even-numbered row and odd-numbered column, i.e., the second target theoretical pixel corresponding to the target actual pixel.

Referring to FIG. 20, FIG. 20 is a schematic diagram of an arrangement mode of theoretical pixels of a point composed of second-type pixels or third-type pixels according to an embodiment of the present disclosure. As long as the theoretical pixels in the pixel window meet the arrangement mode in FIG. 17, it is judged that there is a point in the pixel window. In FIG. 20, black refers to the first-type pixel, color refers to the third-type pixel, white refers to the second-type pixel, i refers to a row number, and j refers to a column number. The pixel window in FIG. 20 is a 3*7 pixel window, and gray grids represent theoretical pixels in the pixel window that do not contribute to the judgement of the point.

Point Composed of First-Type Pixels

Figure 21:
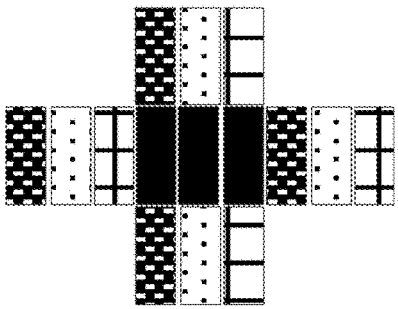
FIG. 21 is another schematic diagram of a point according to an embodiment of the present disclosure.

Referring to FIG. 21, this embodiment of the present disclosure takes a 1-pixel black point on a white background as an example for illustration. It should be noted that white is not only white of 255 grayscales, and is specifically related to the third threshold Critical_W. Similarly, black is not only black of 255 grayscale and is specifically related to the first threshold Critical_B.

Figure 23:
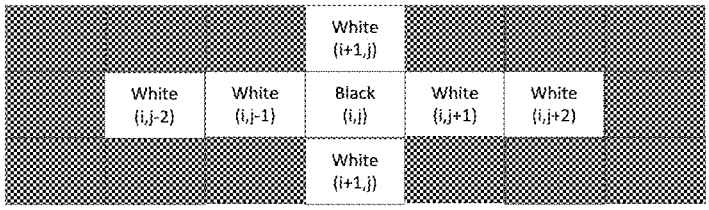
FIG. 23 is a schematic diagram of another pixel arrangement of a point according to an embodiment of the present disclosure.

In one embodiment of the present disclosure, referring to FIG. 23, when the theoretical pixels in the pixel window meet the following arrangement mode, it is judged that there is a point graphic in the pixel window:

within the pixel window, a target theoretical pixel corresponding to the target actual pixel is located in the second row of the pixel window; the target theoretical pixel is the first-type pixel; two theoretical pixels adjacent to a left side of the target theoretical pixel, two theoretical pixels adjacent to a right side of the target theoretical pixel, a theoretical pixel at an upper side of the target theoretical pixel, and a theoretical pixel at a lower side of the target theoretical pixel, are second-type pixels.

The calculating grayscale data of each actual sub-pixel of each actual pixel further includes:

mapping grayscale data of each theoretical sub-pixel of the target theoretical pixel marked as the first-type pixel to each same-color actual sub-pixel of the target actual pixel, respectively.

Figure 22:
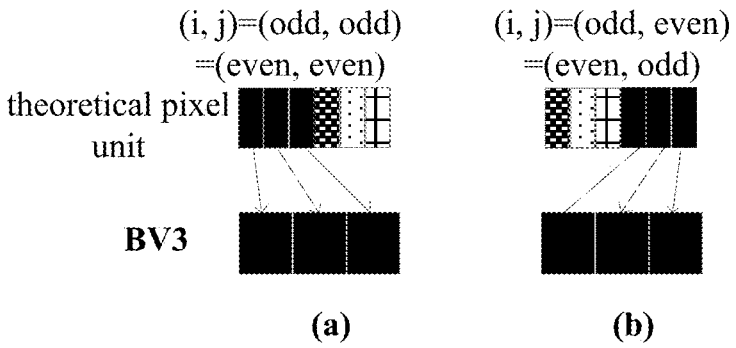
FIG. 22 is a schematic diagram of another mapping mode of a point according to an embodiment of the present disclosure.

Referring to FIG. 22, grayscale data of each theoretical sub-pixel of the target theoretical pixel marked as the first-type pixel is mapped to each same-color actual sub-pixel of the target actual pixel, respectively. The target theoretical pixel may be a theoretical sub-pixel in odd-numbered row and odd-numbered column, or a theoretical sub-pixel in even-numbered row and even-numbered column, i.e., the first target theoretical pixel corresponding to the target actual pixel. The target theoretical pixel may also be a theoretical sub-pixel in odd-numbered row and even-numbered column, or a theoretical sub-pixel in even-numbered row and odd-numbered column, i.e., the second target theoretical pixel corresponding to the target actual pixel.

Referring to FIG. 23, FIG. 23 is a schematic diagram of an arrangement mode of theoretical pixels of a point composed of first-type pixels according to an embodiment of the present disclosure. As long as the theoretical pixels in the pixel window meet the arrangement mode in FIG. 23, it is judged that there is a point in the pixel window. In FIG. 23, black refers to the first-type pixel, white refers to the second-type pixel, i refers to a row number, and j refers to a column number. The pixel window in FIG. 23 is a 3*7 pixel window, and gray grids represent theoretical pixels in the pixel window that do not contribute to the judgement of the point.

2×2 Checkerboard

Figure 24:
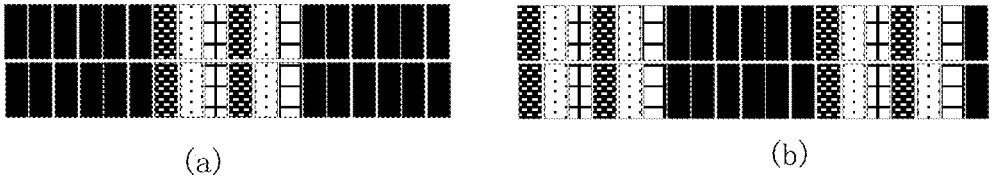
FIG. 24 is a schematic diagram of a 2×2 checkerboard according to an embodiment of the present disclosure.

Referring to FIG. 24, there are two arrangement modes of pixels for a 2×2 checkerboard graphic.

Figure 26:
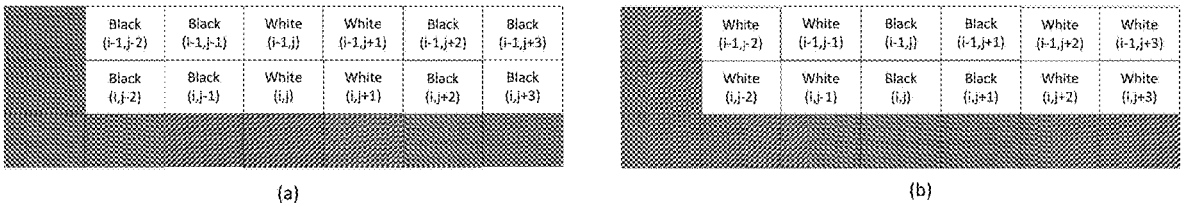
FIG. 26 is a schematic diagram of a pixel arrangement of a 2×2 checkerboard according to an embodiment of the present disclosure.

In one embodiment of the present disclosure, referring to FIG. 26, when the theoretical pixels in the pixel window meet the following arrangement mode, it is judged that there is 2×2 checkerboard graphic in the pixel window:

the pixel window includes two rows of theoretical pixels for judgement, each row includes six consecutive theoretical pixels; two theoretical pixels in the middle of the first row and the second row are the second-type pixels, and the rest are the first-type pixels; the target theoretical pixels are located in the second row and one of them is the second-type pixel; the target theoretical pixel marked as the second-type pixel is located in odd-numbered row and even-numbered column.

Figure 25:
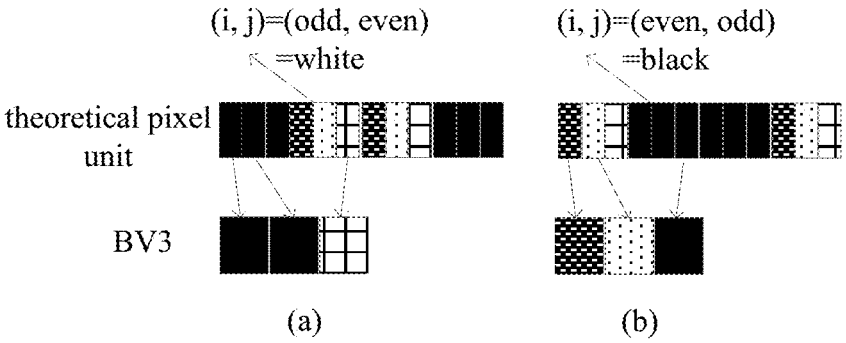
FIG. 25 is a schematic diagram of a mapping mode of a 2×2 checkerboard according to an embodiment of the present disclosure.

Referring to (a) in FIG. 25, grayscale data of the first theoretical sub-pixel and the second theoretical sub-pixel of the target theoretical pixel marked as the first-type pixel is mapped to a first actual sub-pixel and a second actual sub-pixel of the target actual pixel, respectively; grayscale data of the last theoretical sub-pixel of the target theoretical pixel marked as the second-type pixel is mapped to the last actual sub-pixel of the target actual pixel.

Or, when the theoretical pixels in the pixel window meet the following arrangement mode, it is judged that there is 2×2 checkerboard graphic in the pixel window:

the pixel window includes two rows of theoretical pixels for judgement, each row includes six consecutive theoretical pixels; the two theoretical pixels in the middle of the first row and the second row are the first-type pixels, and the rest are the second-type pixel; the target theoretical pixels are located in the second row and one of them is the first-type pixel; the target theoretical pixel marked as the first-type pixel is located in even-numbered row and odd-numbered column.

The calculating grayscale data of each actual sub-pixel of each actual pixel further includes:

referring to (b) in FIG. 25, mapping grayscale data of the first theoretical sub-pixel and the second theoretical sub-pixel of the target theoretical pixel marked as the second-type pixel to the first actual sub-pixel and the second actual sub-pixel of the target actual pixel, respectively; mapping grayscale data of the last theoretical sub-pixel of the target theoretical pixel marked as the first-type pixel to the last actual sub-pixel of the target actual pixel.

Referring to FIG. 26, FIG. 26 is a schematic diagram of an arrangement mode of theoretical pixels of a 2×2 checkerboard graphic according to an embodiment of the present disclosure. As long as the theoretical pixels in the pixel window meet the arrangement mode in FIG. 26, it is judged that there is a 2×2 checkerboard graphic in the pixel window. In FIG. 26, black refers to the first-type pixel, white refers to the second-type pixel, i refers to a row number, and j refers to a column number. The pixel window in FIG. 26 is a 3*7 pixel window, and gray grids represent theoretical pixels in the pixel window that do not contribute to the judgement of the checkerboard.

3×3 Checkerboard

Figure 27:
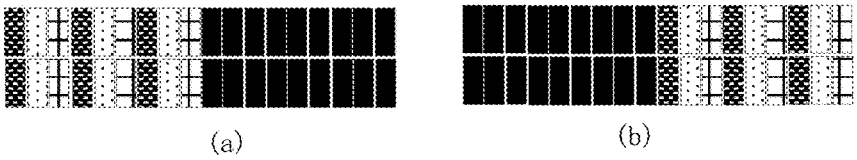
FIG. 27 is a schematic diagram of a 3×3 checkerboard according to an embodiment of the present disclosure.

Referring to FIG. 27, there are two arrangement modes of pixels for a 3×3 checkerboard graphic.

Figure 29:
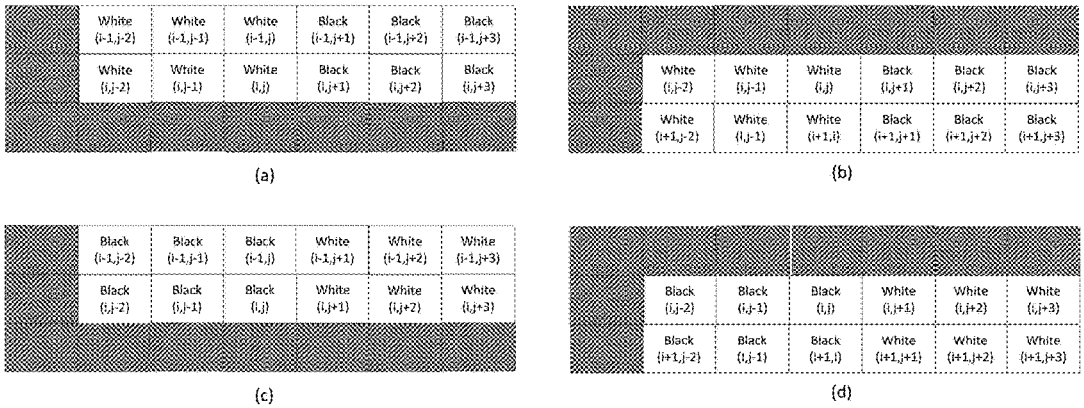
FIG. 29 is a schematic diagram of a pixel arrangement of a 3×3 checkerboard according to an embodiment of the present disclosure.

In one embodiment of the present disclosure, referring to FIG. 29, when the theoretical pixels in the pixel window meet the following arrangement mode, it is judged that there is 3×3 checkerboard graphic in the pixel window:

the pixel window includes two rows of theoretical pixels for judgement, each row includes six consecutive theoretical pixels; in the two rows of theoretical pixels for judgement, the first three theoretical pixels of the first row and the second row are the second-type pixel, the last three theoretical pixels are the first-type pixel; the target theoretical pixels are located in the second row and one of them is the second-type pixel, and the other is the first-type pixel; the target theoretical pixel marked as the second-type pixel is located in odd-numbered row and odd-numbered column, or even-numbered row and odd-numbered column;

the two rows of theoretical pixels for judgement may be the first row and the second row in the pixel window, or the second row and the third row in the pixel window.

Figure 28:
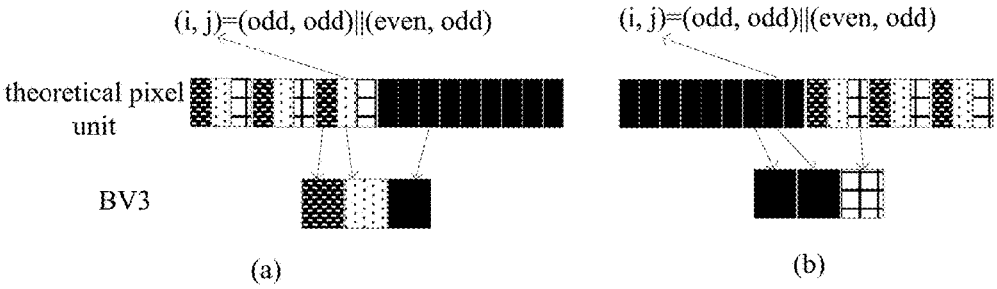
FIG. 28 is a schematic diagram of a mapping mode of a 3×3 checkerboard according to an embodiment of the present disclosure.

The calculating grayscale data of each actual sub-pixel of each actual pixel further includes:

referring to (a) in FIG. 28, mapping grayscale data of the first theoretical sub-pixel and the second theoretical sub-pixel of the target theoretical pixel marked as the second-type pixel to the first actual sub-pixel and the second actual sub-pixel of the target actual pixel, respectively; mapping grayscale data of the last theoretical sub-pixel of the target theoretical pixel marked as the first-type pixel to the last actual sub-pixel of the target actual pixel.

Or, when the theoretical pixels in the pixel window meet the following arrangement mode, it is judged that there is 3×3 checkerboard graphic in the pixel window:

the pixel window includes two rows of theoretical pixels for judgement, each row includes six consecutive theoretical pixels; in the two rows of theoretical pixels for judgement, the first three theoretical pixels of the first row and the second row are the first-type pixel, the last three theoretical pixels are the second-type pixel; the target theoretical pixels are located in the second row and one of them is the first-type pixel, and the other is the second-type pixel; the target theoretical pixel marked as the first-type pixel is located in odd-numbered row and odd-numbered column, or even-numbered row and odd-numbered column;

the two rows of theoretical pixels for judgement may be the first row and the second row in the pixel window, or the second row and the third row in the pixel window.

The calculating grayscale data of each actual sub-pixel of each actual pixel further includes:

referring to (b) in FIG. 28, mapping grayscale data of the first theoretical sub-pixel and the second theoretical sub-pixel of the target theoretical pixel marked as the first-type pixel to the first actual sub-pixel and the second actual sub-pixel of the target actual pixel, respectively; mapping grayscale data of the last theoretical sub-pixel of the target theoretical pixel marked as the second-type pixel to the last actual sub-pixel of the target actual pixel.

Referring to FIG. 29, FIG. 29 is a schematic diagram of an arrangement mode of theoretical pixels of a 3×3 checkerboard graphic according to an embodiment of the present disclosure. As long as the theoretical pixels in the pixel window meet the arrangement mode in FIG. 29, it is judged that there is a 3×3 checkerboard graphic in the pixel window. In FIG. 29, black refers to the first-type pixel, white refers to the second-type pixel, i refers to a row number, and j refers to a column number. The pixel window in FIG. 29 is a 3*7 pixel window, and gray grids represent theoretical pixels in the pixel window that do not contribute to the judgement of the checkerboard.

Through the image rendering modes provided in the above embodiments, for some images with obvious details, such as a 1-pixel bright line on a dark background, a bright point on a dark background, and 2×2 pixel checkerboard, different image rendering modes may be employed for different detail features, which can effectively retain the detail features, thereby improving the display effect of the display device with the BV3 pixel structure.

Figure 30:
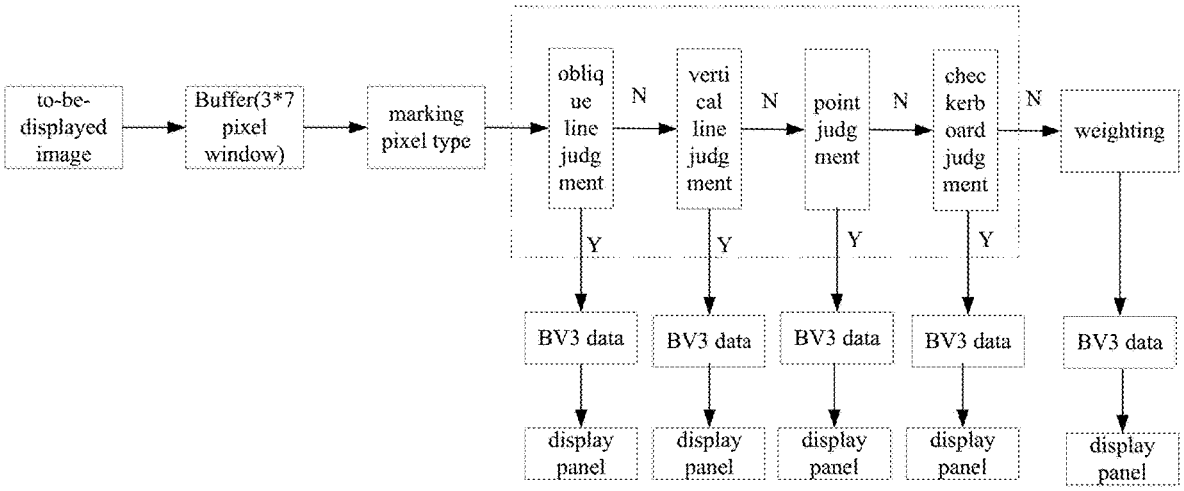
FIG. 30 is another schematic flowchart of an image processing method according to an embodiment of the present disclosure.

In some embodiments of the present disclosure, any one or more of the above detail judgments (such as oblique line judgment, vertical line judgment, point judgment, checkerboard judgment) may be performed on the image. Referring to FIG. 30, in some embodiments of the present disclosure, it can be judged in sequence whether the pixel window of the to-be-displayed image contains oblique line, vertical line, point, and checkerboard. If it judged there is one of them, the corresponding image rendering mode is used for rendering. The oblique line judgment is prior to the vertical line judgment, the reason is to avoid determination of the vertical line as a vertical line. If the specified details are not included in the pixel window, the weighted mode (i.e., the second rendering mode) is used for rendering, and finally image data conforming to the BV3 pixel structure is obtained and then is output to a display panel for displaying.

In the embodiment of the present disclosure, by judging the specified detail features in the image and using different BV3 image processing modes for different types of detail features, it can effectively retain detail features of the image, which solves the problem that after BV3 rendering is performed on a Real RGB image, detail features of the image are lost, the oblique line breaks and becomes weak.

Figure 31:
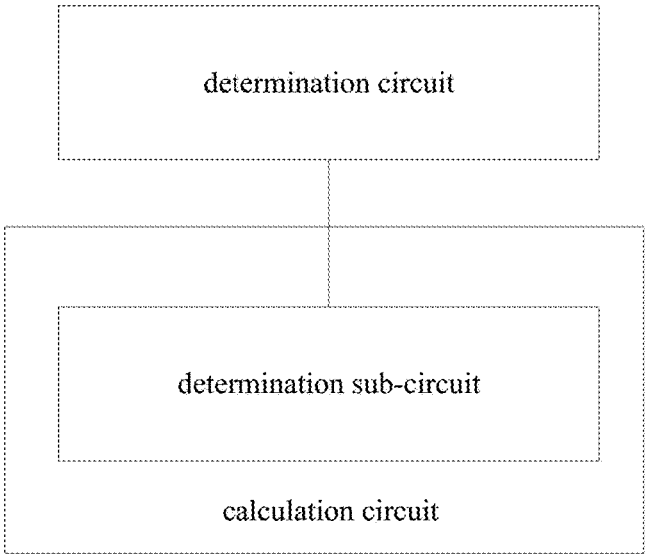
FIG. 31 is a schematic diagram of a display device according to an embodiment of the present disclosure.

Referring to FIG. 31, the present disclosure further provides a display device. The display device includes multiple rows of actual pixels. Each actual pixel includes multiple actual sub-pixels. Starting positions of the actual sub-pixels in odd-numbered and even-numbered rows are staggered by a distance of half of an actual sub-pixel. The display device further includes:

a determination circuit configured to determine multiple rows of theoretical pixels corresponding to a to-be-displayed image, where each theoretical pixel includes multiple theoretical sub-pixels, and each actual pixel corresponds to at least two theoretical pixels;

a calculation circuit configured to calculate grayscale data of each actual sub-pixel of each actual pixel.

The calculation circuit includes:

a determination sub-circuit configured to, for a target actual pixel, determine a rendering mode for calculating the grayscale data of each actual sub-pixel of the target actual pixel according to whether there is a specified detail feature in a pixel area where target theoretical pixels corresponding to the target actual pixel are located, where when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed.

Optionally, the determination sub-circuit is configured to, when there is not a specified detail feature in the pixel area where target theoretical pixels are located, for a target actual sub-pixel of the target actual pixel, obtain a weighted average of grayscale data of the same-color theoretical sub-pixels in the target theoretical pixels; and, determine grayscale data of the target actual sub-pixel according to the weighted average of grayscale data of the same-color theoretical sub-pixels.

Optionally, in one row of the odd-numbered row and the even-numbered row of actual pixels, each actual pixel corresponds to two theoretical pixels; and each of the actual pixel and the theoretical pixels includes a first-color sub-pixel, a second-color sub-pixel and a third-color sub-pixel; grayscale data of the first-color sub-pixel, the second-color sub-pixel and the third-color sub-pixel of the actual pixels are calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

Where $\partial 1+\beta 1=1$, Bs represents grayscale data of the first-color sub-pixel of the actual pixel, Rs represents grayscale data of the second-color sub-pixel of the actual pixel, and Gs represents grayscale data of the third-color sub-pixel of the actual pixel, Ba and Bb represent grayscale data of first-color sub-pixels of the two target theoretical pixels corresponding to the actual pixel, Ra and Rb represent grayscale data of second-color sub-pixels of the two target theoretical pixels corresponding to the actual pixel, and Ga and Gb represent grayscale data of third-color sub-pixels of the two target theoretical pixels corresponding to the actual pixel.

In the other row of the odd-numbered row and the even-numbered row of actual pixels, two boundary actual sub-pixels and multiple intermediate actual sub-pixels are included; each of the two boundary actual sub-pixels corresponds to three theoretical pixels; each of the intermediate actual sub-pixels corresponds to two theoretical pixels.

A first boundary actual pixel of the two boundary actual pixels includes two first-color sub-pixels, one second-color sub-pixel and one third-color sub-pixel; and grayscale data of each actual sub-pixel of the first boundary actual pixel is calculated as:

$$Bs1=((\partial 2*Ba+\beta 2*Bb+r2*Bc)*0.5);$$

$$Bs2=Bs1;$$

$$Rs=(\partial 2*Ra+\beta 2*Rb+r2*Rc);$$

$$Gs=(\partial 2*Ga+\beta 2*Gb+r2*Gc);$$

Where $\alpha 2+\beta 2+\gamma 2=1$, Bs1 and Bs2 represent grayscale data of the two first-color sub-pixels of the first boundary actual pixel, Rs represents grayscale data of the second-color sub-pixel of the first boundary actual pixel, Gs represents grayscale data of the third-color sub-pixel of the first boundary actual pixel; Ba, Bb and Bc represent grayscale data of the first-color sub-pixels of the three target theoretical pixels corresponding to the first boundary actual pixel, respectively; Ra, Rb and Rc represent grayscale data of the second-color sub-pixels of the three target theoretical pixels corresponding to the first boundary actual pixel, respectively; and Ga, Gb and Gc represent grayscale data of the third-color sub-pixels of the three target theoretical pixels corresponding to the first boundary actual pixel, respectively.

A second boundary actual pixel includes one first-color sub-pixel, two second-color sub-pixels and two third-color sub-pixels; and grayscale data of each actual sub-pixel of the second boundary actual pixel is calculated as:

$$Bs=((\partial 3*Ba+\beta 3*Bb+r3*Bc));$$

$$Rs1=((\partial 3*Ra+\beta 3*Rb+r3*Rc)*0.5);$$

$$Rs2=Rs1;$$

$$Gs1=((\partial 3*Ga+\beta 3*Gb+r3*Gc)*0.5);$$

$$Gs2=Gs1;$$

Where $\partial 3+\beta 3+r3=1$, Bs represents grayscale data of the first-color sub-pixel of the second boundary actual pixel; Rs1 and Rs2 represent grayscale data of the two second-color sub-pixels of the second boundary actual pixel; Gs1 and Gs2 represent grayscale data of the two third-color sub-pixels of the second boundary actual pixel; Ba, Bb and Bc represent grayscale data of first-color sub-pixels of three target theoretical pixels corresponding to the second boundary actual pixel, Ra, Rb and Rc represent grayscale data of second-color sub-pixels of three target theoretical pixels corresponding to the second boundary actual pixel; and Ga, Gb and Gc represent grayscale data of third-color sub-pixels of three target theoretical pixels corresponding to the second boundary actual pixel.

Grayscale data of each actual sub-pixel of the intermediate actual pixel is calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

Where $\partial 1+\beta 1=1$, Bs represents grayscale data of a first-color sub-pixel of the intermediate actual pixel; Rs represents grayscale data of a second-color sub-pixel of the intermediate actual pixel; Gs represents grayscale data of a third-color sub-pixel of the intermediate actual pixel; Ba and Bb represent grayscale data of first-color sub-pixels of two target theoretical pixels corresponding to the intermediate actual pixels, respectively; Ra and Rb represent grayscale data of second-color sub-pixels of two target theoretical pixels corresponding to the intermediate actual pixels, respectively; Ga and Gb represent grayscale data of third-color sub-pixels of two target theoretical pixels corresponding to the intermediate actual pixels, respectively.

Optionally, the specified detail feature includes at least one of the following:

oblique line;

vertical line;

point;

checkerboard.

Optionally, the calculation circuit further includes: an obtaining sub-circuit configured to obtain a pixel window corresponding to the target theoretical pixel, where the pixel window includes n rows and m columns of the theoretical pixels, n and m are positive integers; and a determination sub-circuit configured to determine whether there is a specified detail feature in the pixel window.

Optionally, n is equal to 3, m is equal to 7.

Optionally, the determination sub-circuit is configured to, mark a pixel type of each theoretical pixel in the pixel window; according to the pixel type of each theoretical pixel in the pixel window and an arrangement mode, as well as a pre-stored arrangement mode of theoretical pixels corresponding to the specified detail feature, determine whether the to-be-displayed image has a specified detail feature in the pixel window.

Optionally, the determination sub-circuit is configured to, judge whether each theoretical pixel in the pixel window is of a preset pixel type, where the pixel type includes at least one of the following:

a first-type pixel, where grayscale data of each theoretical sub-pixel in the first-type pixel is less than a first threshold;

a second-type pixel, where grayscale data of each theoretical sub-pixel in the second-type pixel is greater than a second threshold;

a third-type pixel, where grayscale data of each theoretical sub-pixel in the third-type pixel is greater than a third threshold;

a fourth-type pixel, where grayscale data of a first-color sub-pixel in the fourth-type pixel is greater than the second threshold, and the fourth-type pixel is a theoretical pixel of odd-numbered row and odd-numbered column or a theoretical pixel of even-numbered row and even-numbered column;

a fifth-type pixel, where grayscale data of a second-color sub-pixel or a third-color sub-pixel of the fifth-type pixel is greater than the second threshold, and the fifth-type pixel is a theoretical pixel of an odd-numbered row and even-numbered column or a theoretical pixel of an even-numbered odd-numbered column theoretical pixel.

Optionally, the determination sub-circuit is configured to, when the theoretical pixels in the pixel window meet the following arrangement mode, judge that there is a vertical oblique line in the pixel window:

the pixel window includes two rows of theoretical pixels for judgement, each of the two rows of theoretical pixels for judgement includes five consecutive theoretical pixels for judgement, and the two rows of theoretical pixels for judgement are staggered by one theoretical pixel; among the five consecutive theoretical pixels for judgement, one of the theoretical pixels in the middle is the fourth-type pixel, and four of the theoretical pixels at two sides are the first-type pixels.

The calculation circuit further includes: a first calculation sub-circuit configured to map grayscale data of each theoretical sub-pixel of the target theoretical pixel marked as the fourth-type pixel to each same-color actual sub-pixel of the target actual pixel.

Optionally, the determination sub-circuit is configured to, when the theoretical pixels in the pixel window meet the following arrangement mode, judge that there is a transverse oblique line in the pixel window:

the pixel window includes three rows of theoretical pixels for judgement, each of the first row and the third row includes three consecutive theoretical pixels for judgement, the second row includes four consecutive theoretical pixels for judgement, the second row and one of the first row and the third row are staggered by one theoretical pixel; a first theoretical pixel for judgment in the first row, a last theoretical pixel for judgment in the third row, and the two theoretical pixels for judgment in the middle of the second row are the second-type pixels or the third-type pixels and the rest are the first-type pixels, or a last theoretical pixel for judgment in the first row, a first theoretical pixel for judgment in the third row, and the two theoretical pixels for judgment in the middle of the second row are the second-type pixels or the third-type pixels and the rest are the first-type pixels.

The first calculation sub-circuit is configured to map two target theoretical pixels marked as the second-type pixel or the third-type pixel in the second row to two consecutive actual pixels, respectively.

Optionally, the determination sub-circuit is configured to, when the theoretical pixels in the pixel window meet the following arrangement mode, judge that there is a vertical line graphic in the pixel window:

the pixel window includes two rows of theoretical pixels for judgement, each row includes three consecutive theoretical pixels for judgement; the theoretical pixel in the middle of each row is the second-type pixel or the third-type pixel, and the rest are the first-type pixels.

The calculation circuit further includes: a second calculation sub-circuit configured to, when a target theoretical pixel marked as the second-type pixel or the third-type pixel is located in odd-numbered row and odd-numbered column, or even-numbered row and even-numbered column, map a first theoretical sub-pixel and a second theoretical sub-pixel of the target theoretical pixel to a first actual sub-pixel and a second actual sub-pixel of a target actual pixel, respectively; map a last theoretical sub-pixel of a target theoretical pixel marked as the first-type pixel to a third actual sub-pixel of the target actual pixel; when a target theoretical pixel marked as the second-type pixel or the third-type pixel is located in odd-numbered row and even-numbered column, or even-numbered row and odd-numbered column, map a third theoretical sub-pixel of the target theoretical pixel marked as the second-type pixel or the third-type pixel to a third actual sub-pixel of the target actual pixel, map a first theoretical sub-pixel and a second theoretical sub-pixel of the target theoretical pixel marked as the first-type pixel to a first actual sub-pixel and a second actual sub-pixel of the target actual pixel, respectively.

Optionally, the determination sub-circuit is configured to, when the theoretical pixels in the pixel window meet the following arrangement mode, judge that there is a point graphic in the pixel window:

within the pixel window, a target theoretical pixel corresponding to the target actual pixel is located in the second row of the pixel window; the target theoretical pixel is the second-type pixel or the third-type pixel; two theoretical pixels adjacent to a left side of the target theoretical pixel, two theoretical pixels adjacent to a right side of the target theoretical pixel, a theoretical pixel at an upper side, and a theoretical pixel at a lower side, are first-type pixels.

The calculation circuit further includes: a third calculation sub-circuit configured to map grayscale data of each theoretical sub-pixel of the target theoretical pixel marked as the second-type pixel or the third-type pixel to each same-color actual sub-pixel of the target actual pixel, respectively.

Optionally, the determination sub-circuit is configured to, when the theoretical pixels in the pixel window meet the following arrangement mode, judge that there is a point graphic in the pixel window:

within the pixel window, a target theoretical pixel corresponding to the target actual pixel is located in the second row of the pixel window; the target theoretical pixel is the first-type pixel; two theoretical pixels adjacent to a left side of the target theoretical pixel, two theoretical pixels adjacent to a right side of the target theoretical pixel, a theoretical pixel at an upper side of the target theoretical pixel, and a theoretical pixel at a lower side of the target theoretical pixel, are second-type pixels.

The calculation circuit further includes: a fourth calculation sub-circuit configured to map grayscale data of each theoretical sub-pixel of the target theoretical pixel marked as the first-type pixel to each same-color actual sub-pixel of the target actual pixel, respectively.

Optionally, the determination sub-circuit is configured to, when the theoretical pixels in the pixel window meet the following arrangement mode, judge that there is a 2×2 checkerboard graphic in the pixel window:

the pixel window includes two rows of theoretical pixels for judgement, each row includes six consecutive theoretical pixels; two theoretical pixels in the middle of the first row and the second row are the second-type pixels, and the rest are the first-type pixels; the target theoretical pixels are located in the second row and one of them is the second-type pixel; the target theoretical pixel marked as the second-type pixel is located in odd-numbered row and even-numbered column.

The calculation circuit further includes: a fifth calculation sub-circuit configured to map grayscale data of the first theoretical sub-pixel and the second theoretical sub-pixel of the target theoretical pixel marked as the first-type pixel to a first actual sub-pixel and a second actual sub-pixel of the target actual pixel, respectively; map grayscale data of the last theoretical sub-pixel of the target theoretical pixel marked as the second-type pixel to the last actual sub-pixel of the target actual pixel.

Optionally, the determination sub-circuit is configured to, when the theoretical pixels in the pixel window meet the following arrangement mode, judge that there is a 2×2 checkerboard graphic in the pixel window:

the pixel window includes two rows of theoretical pixels for judgement, each row includes six consecutive theoretical pixels; the two theoretical pixels in the middle of the first row and the second row are the first-type pixels, and the rest are the second-type pixel; the target theoretical pixels are located in the second row and one of them is the first-type pixel; the target theoretical pixel marked as the first-type pixel is located in even-numbered row and odd-numbered column.

The calculation circuit further includes: a sixth calculation sub-circuit configured to map grayscale data of the first theoretical sub-pixel and the second theoretical sub-pixel of the target theoretical pixel marked as the second-type pixel to the first actual sub-pixel and the second actual sub-pixel of the target actual pixel, respectively; map grayscale data of the last theoretical sub-pixel of the target theoretical pixel marked as the first-type pixel to the last actual sub-pixel of the target actual pixel.

Optionally, the determination sub-circuit is configured to, when the theoretical pixels in the pixel window meet the following arrangement mode, judge that there is a 3×3 checkerboard graphic in the pixel window:

the pixel window includes two rows of theoretical pixels for judgement, each row includes six consecutive theoretical pixels; in the two rows of theoretical pixels for judgement, the first three theoretical pixels of the first row and the second row are the second-type pixels, the last three theoretical pixels are the first-type pixels; the target theoretical pixels are located in the second row and one of them is the second-type pixel, and the other is the first-type pixel; the target theoretical pixel marked as the second-type pixel is located in odd-numbered row and odd-numbered column, or even-numbered row and odd-numbered column;

The calculation circuit further includes: a seventh calculation sub-circuit configured to, map grayscale data of the first theoretical sub-pixel and the second theoretical sub-pixel of the target theoretical pixel marked as the second-type pixel to the first actual sub-pixel and the second actual sub-pixel of the target actual pixel, respectively; map grayscale data of the last theoretical sub-pixel of the target theoretical pixel marked as the first-type pixel to the last actual sub-pixel of the target actual pixel.

Optionally, the determination sub-circuit is configured to, when the theoretical pixels in the pixel window meet the following arrangement mode, judge that there is a 3×3 checkerboard graphic in the pixel window:

the pixel window includes two rows of theoretical pixels for judgement, each row includes six consecutive theoretical pixels; in the two rows of theoretical pixels for judgement, the first three theoretical pixels of the first row and the second row are the first-type pixel, the last three theoretical pixels are the second-type pixel; the target theoretical pixels are located in the second row and one of them is the first-type pixel, and the other is the second-type pixel; the target theoretical pixel marked as the first-type pixel is located in odd-numbered row and odd-numbered column, or even-numbered row and odd-numbered column.

The calculation module further includes: an eighth calculation sub-circuit configured to, map grayscale data of the first theoretical sub-pixel and the second theoretical sub-pixel of the target theoretical pixel marked as the first-type pixel to the first actual sub-pixel and the second actual sub-pixel of the target actual pixel, respectively; map grayscale data of the last theoretical sub-pixel of the target theoretical pixel marked as the second-type pixel to the last actual sub-pixel of the target actual pixel.

One embodiment of the present disclosure further provides a display device, including a processor, a memory, and a computer program stored on the memory and executable on the processor. The computer program is executed by the processor to implement various processes of the above image processing method embodiment with the same technical effect being achieved. To avoid repetition, details will not be repeated here.

One embodiment of the present disclosure further provides a computer-readable storage medium including a computer program stored thereon. The computer program is executed by a processor to implement various processes of the above image processing method embodiment with the same technical effect being achieved. To avoid repetition, details will not be repeated here. The computer-readable storage medium may be, for example, a read-only memory (ROM), a random access memory (RAM), a magnetic disk or an optical disk.

The above are merely the preferred embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure.

What is claimed is:

1. An image processing method applied to a display device which includes a plurality of rows of actual pixels, each actual pixel includes a plurality of actual sub-pixels, and starting positions of the actual sub-pixels in odd-numbered and even-numbered rows are staggered by a distance of half of an actual sub-pixel; the method comprising:

determining a plurality of rows of theoretical pixels corresponding to a to-be-displayed image, wherein each theoretical pixel includes a plurality of theoretical sub-pixels, and each actual pixel corresponds to at least two theoretical pixels;

calculating grayscale data of each actual sub-pixel of each actual pixel;

wherein the calculating grayscale data of each actual sub-pixel of each actual pixel, includes:

for a target actual pixel, determining a rendering mode for calculating the grayscale data of each actual sub-pixel of the target actual pixel according to whether there is a specified detail feature in a pixel area where target theoretical pixels corresponding to the target actual pixel are located, wherein when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed, wherein for a target actual pixel, determining a rendering mode for calculating the grayscale data of each actual sub-pixel of the target actual pixel according to whether there is a specified detail feature in a pixel area where target theoretical pixels corresponding to the target actual pixel are located, includes:

when there is not a specified detail feature in the pixel area where target theoretical pixels are located, for a target actual sub-pixel of the target actual pixel, obtaining a weighted average of grayscale data of the same-color theoretical sub-pixels in the target theoretical pixels;

determining grayscale data of the target actual sub-pixel according to the weighted average of grayscale data of the same-color theoretical sub-pixels.

2. The image processing method according to claim 1, wherein in one row of the odd-numbered row and the even-numbered row of actual pixels, each actual pixel corresponds to two theoretical pixels; and each of the actual pixel and the theoretical pixels includes a first-color sub-pixel, a second-color sub-pixel and a third-color sub-pixel; grayscale data of the first-color sub-pixel, the second-color sub-pixel and the third-color sub-pixel of the actual pixels are calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

where $\partial 1+\beta 1=1$, Bs represents grayscale data of the first-color sub-pixel of the actual pixel, Rs represents grayscale data of the second-color sub-pixel of the actual pixel, and Gs represents grayscale data of the third-color sub-pixel of the actual pixel, Ba and Bb represent grayscale data of first-color sub-pixels of the two target theoretical pixels corresponding to the actual pixel, Ra and Rb represent grayscale data of second-color sub-pixels of the two target theoretical pixels corresponding to the actual pixel, and Ga and Gb represent grayscale data of third-color sub-pixels of the two target theoretical pixels corresponding to the actual pixel;

in the other row of the odd-numbered row and the even-numbered row of actual pixels, two boundary actual sub-pixels and multiple intermediate actual sub-pixels are included;

each of the two boundary actual sub-pixels correspond to three theoretical pixels; each of the intermediate actual sub-pixels corresponds to two theoretical pixels;

a first boundary actual pixel of the two boundary actual pixels includes two first-color sub-pixels, one second-color sub-pixel and one third-color sub-pixel; and grayscale data of each actual sub-pixel of the first boundary actual pixel is calculated as:

$$Bs1=((\partial 2*Ba+\beta 2*Bb+r2*Bc)*0.5);$$

$$Bs2=Bs1;$$

$$Rs=(\partial 2*Ra+\beta 2*Rb+r2*Rc);$$

$$Gs=(\partial 2*Ga+\beta 2*Gb+r2*Gc);$$

where $\alpha 2+\beta 2+\gamma 2=1$, Bs1 and Bs2 represent grayscale data of the two first-color sub-pixels of the first boundary actual pixel, Rs represents grayscale data of the second-color sub-pixel of the first boundary actual pixel, Gs represents grayscale data of the third-color sub-pixel of the first boundary actual pixel; Ba, Bb and Bc represent grayscale data of the first-color sub-pixels of the three target theoretical pixels corresponding to the first boundary actual pixel, respectively; Ra, Rb and Rc represent grayscale data of the second-color sub-pixels of the three target theoretical pixels corresponding to the first boundary actual pixel, respectively; and Ga, Gb and Gc represent grayscale data of the third-color sub-pixels of the three target theoretical pixels corresponding to the first boundary actual pixel, respectively;

a second boundary actual pixel includes one first-color sub-pixel, two second-color sub-pixels and two third-color sub-pixels; and grayscale data of each actual sub-pixel of the second boundary actual pixel is calculated as:

$$Bs=((\partial 3*Ba+\beta 3*Bb+r3*Bc));$$

$$Rs1=((\partial 3*Ra+\beta 3*Rb+r3*Rc)*0.5);$$

$$Rs2=Rs1;$$

$$Gs1=((\partial 3*Ga+\beta 3*Gb+r3*Gc)*0.5);$$

$$Gs2=Gs1;$$

where $\partial 3+\beta 3+r3=1$, Bs represents grayscale data of the first-color sub-pixel of the second boundary actual pixel; Rs1 and Rs2 represent grayscale data of the two second-color sub-pixels of the second boundary actual pixel; Gs1 and Gs2 represent grayscale data of the two third-color sub-pixels of the second boundary actual pixel; Ba, Bb and Bc represent grayscale data of first-color sub-pixels of three target theoretical pixels corresponding to the second boundary actual pixel, Ra, Rb and Rc represent grayscale data of second-color sub-pixels of three target theoretical pixels corresponding to the second boundary actual pixel; and Ga, Gb and Gc represent grayscale data of third-color sub-pixels of three target theoretical pixels corresponding to the second boundary actual pixel;

grayscale data of each actual sub-pixel of the intermediate actual pixel is calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

where $\partial 1+\beta 1=1$, Bs represents grayscale data of a first-color sub-pixel of the intermediate actual pixel; Rs represents grayscale data of a second-color sub-pixel of the intermediate actual pixel; Gs represents grayscale data of a third-color sub-pixel of the intermediate actual pixel; Ba and Bb represent grayscale data of first-color sub-pixels of two target theoretical pixels corresponding to the intermediate actual pixels, respectively; Ra and Rb represent grayscale data of second-color sub-pixels of two target theoretical pixels corresponding to the intermediate actual pixels, respectively; Ga and Gb represent grayscale data of third-color sub-pixels of two target theoretical pixels corresponding to the intermediate actual pixels, respectively.

3. The image processing method according to claim 1, wherein the specified detail feature includes at least one of the following:

oblique line;

vertical line;

point;

checkerboard.

4. The image processing method according to claim 3, wherein before, for a target actual pixel, determining a rendering mode for calculating the grayscale data of each actual sub-pixel of the target actual pixel according to whether there is a specified detail feature in a pixel area where target theoretical pixels corresponding to the target actual pixel are located, the method further includes:

obtaining a pixel window corresponding to the target theoretical pixel, wherein the pixel window includes n rows and m columns of the theoretical pixels, n and m are positive integers; and determining whether there is a specified detail feature in the pixel window.

5. The image processing method according to claim 4, wherein n is equal to 3, and m is equal to 7.

6. The image processing method according to claim 4, wherein the determining whether there is a specified detail feature in the pixel window, includes:

marking a pixel type of each theoretical pixel in the pixel window;

according to the pixel type of each theoretical pixel in the pixel window and an arrangement mode, as well as a pre-stored arrangement mode of theoretical pixels corresponding to the specified detail feature, determining whether the to-be-displayed image has a specified detail feature in the pixel window.

7. The image processing method according to claim 6, wherein the marking a pixel type of each theoretical pixel in the pixel window, includes:

judging whether each theoretical pixel in the pixel window is of a preset pixel type, wherein the pixel type includes at least one of the following:

a first-type pixel, wherein grayscale data of each theoretical sub-pixel in the first-type pixel is less than a first threshold;

a second-type pixel, wherein grayscale data of each theoretical sub-pixel in the second-type pixel is greater than a second threshold;

a third-type pixel, wherein grayscale data of each theoretical sub-pixel in the third-type pixel is greater than a third threshold;

a fourth-type pixel, wherein grayscale data of a first-color sub-pixel in the fourth-type pixel is greater than the second threshold, and the fourth-type pixel is a theoretical pixel of odd-numbered row and odd-numbered column or a theoretical pixel of even-numbered row and even-numbered column;

a fifth-type pixel, wherein grayscale data of a second-color sub-pixel or a third-color sub-pixel of the fifth-type pixel is greater than the second threshold, and the fifth-type pixel is a theoretical pixel of an odd-numbered row and even-numbered column or a theoretical pixel of an even-numbered odd-numbered column theoretical pixel.

8. The image processing method according to claim 7, wherein the according to the pixel type of each theoretical pixel in the pixel window and an arrangement mode, as well as a pre-stored arrangement mode of theoretical pixels corresponding to the specified detail feature, determining whether the to-be-displayed image has a specified detail feature in the pixel window, includes:

when the theoretical pixels in the pixel window meet the following arrangement mode, judging that there is a vertical oblique line in the pixel window:

the pixel window includes two rows of theoretical pixels for judgement, each of the two rows of theoretical pixels for judgement includes five consecutive theoretical pixels for judgement, and the two rows of theoretical pixels for judgement are staggered by one theoretical pixel; among the five consecutive theoretical pixels for judgement, one of the theoretical pixels in the middle is the fourth-type pixel, and four of the theoretical pixels at two sides are the first-type pixels;

the calculating grayscale data of each actual sub-pixel of each actual pixel, includes:

mapping grayscale data of each theoretical sub-pixel of the target theoretical pixel marked as the fourth-type pixel or the fifth-type pixel to each same-color actual sub-pixel of the target actual pixel.

9. The image processing method according to claim 7, wherein the according to the pixel type of each theoretical pixel in the pixel window and an arrangement mode, as well as a pre-stored arrangement mode of theoretical pixels corresponding to the specified detail feature, determining whether the to-be-displayed image has a specified detail feature in the pixel window, includes:

when the theoretical pixels in the pixel window meet the following arrangement mode, judging that there is a transverse oblique line in the pixel window:

the pixel window includes three rows of theoretical pixels for judgement, each of the first row and the third row includes three consecutive theoretical pixels for judgement, the second row includes four consecutive theoretical pixels for judgement, the second row and one of the first row and the third row are staggered by one theoretical pixel; a first theoretical pixel for judgment in the first row, a last theoretical pixel for judgment in the third row, and the two theoretical pixels for judgment in the middle of the second row are the second-type pixels or the third-type pixels and the rest are the first-type pixels, or a last theoretical pixel for judgment in the first row, a first theoretical pixel for judgment in the third row, and the two theoretical pixels for judgment in the middle of the second row are the second-type pixels or the third-type pixels and the rest are the first-type pixels;

the calculating grayscale data of each actual sub-pixel of each actual pixel, includes:

mapping two target theoretical pixels marked as the second-type pixel or the third-type pixel in the second row to two consecutive actual pixels, respectively.

10. The image processing method according to claim 7, wherein the according to the pixel type of each theoretical pixel in the pixel window and an arrangement mode, as well as a pre-stored arrangement mode of theoretical pixels corresponding to the specified detail feature, determining whether the to-be-displayed image has a specified detail feature in the pixel window, includes:

when the theoretical pixels in the pixel window meet the following arrangement mode, judging that there is a vertical line graphic in the pixel window:

the pixel window includes two rows of theoretical pixels for judgement, each row includes three consecutive theoretical pixels for judgement; the theoretical pixel in the middle of each row is the second-type pixel or the third-type pixel, and the rest are the first-type pixels;

the calculating grayscale data of each actual sub-pixel of each actual pixel, includes:

when a target theoretical pixel marked as the second-type pixel or the third-type pixel is located in odd-numbered row and odd-numbered column, or even-numbered row and even-numbered column, mapping a first theoretical sub-pixel and a second theoretical sub-pixel of the target theoretical pixel to a first actual sub-pixel and a second actual sub-pixel of a target actual pixel, respectively; mapping a last theoretical sub-pixel of a target theoretical pixel marked as the first-type pixel to a third actual sub-pixel of the target actual pixel;

when a target theoretical pixel marked as the second-type pixel or the third-type pixel is located in odd-numbered row and even-numbered column, or even-numbered row and odd-numbered column, mapping a third theoretical sub-pixel of the target theoretical pixel marked as the second-type pixel or the third-type pixel to a third actual sub-pixel of the target actual pixel, mapping a first theoretical sub-pixel and a second theoretical sub-pixel of the target theoretical pixel marked as the first-type pixel to a first actual sub-pixel and a second actual sub-pixel of the target actual pixel, respectively.

11. The image processing method according to claim 7, wherein the according to the pixel type of each theoretical pixel in the pixel window and an arrangement mode, as well as a pre-stored arrangement mode of theoretical pixels corresponding to the specified detail feature, determining whether the to-be-displayed image has a specified detail feature in the pixel window, includes:

when the theoretical pixels in the pixel window meet the following arrangement mode, judging that there is a point graphic in the pixel window:

within the pixel window, a target theoretical pixel corresponding to the target actual pixel is located in the second row of the pixel window; the target theoretical pixel is the second-type pixel or the third-type pixel; two theoretical pixels adjacent to a left side of the target theoretical pixel, two theoretical pixels adjacent to a right side of the target theoretical pixel, a theoretical pixel at an upper side, and a theoretical pixel at a lower side, are first-type pixels;

the calculating grayscale data of each actual sub-pixel of each actual pixel, includes: mapping grayscale data of each theoretical sub-pixel of the target theoretical pixel marked as the second-type pixel or the third-type pixel to each same-color actual sub-pixel of the target actual pixel, respectively;

or, when the theoretical pixels in the pixel window meet the following arrangement mode, judging that there is a point graphic in the pixel window:

within the pixel window, a target theoretical pixel corresponding to the target actual pixel is located in the second row of the pixel window; the target theoretical pixel is the first-type pixel; two theoretical pixels adjacent to a left side of the target theoretical pixel, two theoretical pixels adjacent to a right side of the target theoretical pixel, a theoretical pixel at an upper side of the target theoretical pixel, and a theoretical pixel at a lower side of the target theoretical pixel, are second-type pixels;

the calculating grayscale data of each actual sub-pixel of each actual pixel, includes:

mapping grayscale data of each theoretical sub-pixel of the target theoretical pixel marked as the first-type pixel to each same-color actual sub-pixel of the target actual pixel, respectively.

12. The image processing method according to claim 7, wherein the according to the pixel type of each theoretical pixel in the pixel window and an arrangement mode, as well as a pre-stored arrangement mode of theoretical pixels corresponding to the specified detail feature, determining whether the to-be-displayed image has a specified detail feature in the pixel window, includes:

when the theoretical pixels in the pixel window meet the following arrangement mode, judging that there is a 2×2 checkerboard graphic in the pixel window:

the pixel window includes two rows of theoretical pixels for judgement, each row includes six consecutive theoretical pixels; two theoretical pixels in the middle of the first row and the second row are the second-type pixels, and the rest are the first-type pixels; the target theoretical pixels are located in the second row and one of them is the second-type pixel; the target theoretical pixel marked as the second-type pixel is located in odd-numbered row and even-numbered column;

the calculating grayscale data of each actual sub-pixel of each actual pixel, includes:

mapping grayscale data of the first theoretical sub-pixel and the second theoretical sub-pixel of the target theoretical pixel marked as the first-type pixel to a first actual sub-pixel and a second actual sub-pixel of the target actual pixel, respectively; mapping grayscale data of the last theoretical sub-pixel of the target theoretical pixel marked as the second-type pixel to the last actual sub-pixel of the target actual pixel;

or, when the theoretical pixels in the pixel window meet the following arrangement mode, judging that there is a 2×2 checkerboard graphic in the pixel window:

the pixel window includes two rows of theoretical pixels for judgement, each row includes six consecutive theoretical pixels; the two theoretical pixels in the middle of the first row and the second row are the first-type pixels, and the rest are the second-type pixel; the target theoretical pixels are located in the second row and one of them is the first-type pixel; the target theoretical pixel marked as the first-type pixel is located in even-numbered row and odd-numbered column;

the calculating grayscale data of each actual sub-pixel of each actual pixel, includes:

mapping grayscale data of the first theoretical sub-pixel and the second theoretical sub-pixel of the target theoretical pixel marked as the second-type pixel to the first actual sub-pixel and the second actual sub-pixel of the target actual pixel, respectively; mapping grayscale data of the last theoretical sub-pixel of the target theoretical pixel marked as the first-type pixel to the last actual sub-pixel of the target actual pixel.

13. The image processing method according to claim 7, wherein the according to the pixel type of each theoretical pixel in the pixel window and an arrangement mode, as well as a pre-stored arrangement mode of theoretical pixels corresponding to the specified detail feature, determining whether the to-be-displayed image has a specified detail feature in the pixel window, includes:

when the theoretical pixels in the pixel window meet the following arrangement mode, judging that there is a 3×3 checkerboard graphic in the pixel window:

the pixel window includes two rows of theoretical pixels for judgement, each row includes six consecutive theoretical pixels; in the two rows of theoretical pixels for judgement, first three theoretical pixels of the first row and the second row are the second-type pixels, last three theoretical pixels are the first-type pixels; the target theoretical pixels are located in the second row and one of them is the second-type pixel, and the other is the first-type pixel; the target theoretical pixel marked as the second-type pixel is located in odd-numbered row and odd-numbered column, or even-numbered row and odd-numbered column;

the calculating grayscale data of each actual sub-pixel of each actual pixel, includes:

mapping grayscale data of the first theoretical sub-pixel and the second theoretical sub-pixel of the target theoretical pixel marked as the second-type pixel to the first actual sub-pixel and the second actual sub-pixel of the target actual pixel, respectively; mapping grayscale data of the last theoretical sub-pixel of the target theoretical pixel marked as the first-type pixel to the last actual sub-pixel of the target actual pixel;

or, when the theoretical pixels in the pixel window meet the following arrangement mode, judging that there is a 3×3 checkerboard graphic in the pixel window:

the pixel window includes two rows of theoretical pixels for judgement, each row includes six consecutive theoretical pixels; in the two rows of theoretical pixels for judgement, the first three theoretical pixels of the first row and the second row are the first-type pixels, the last three theoretical pixels are the second-type pixels; the target theoretical pixels are located in the second row and one of them is the first-type pixel, and the other is the second-type pixel; the target theoretical pixel marked as the first-type pixel is located in odd-numbered row and odd-numbered column, or even-numbered row and odd-numbered column;

the calculating grayscale data of each actual sub-pixel of each actual pixel, includes:

mapping grayscale data of the first theoretical sub-pixel and the second theoretical sub-pixel of the target theoretical pixel marked as the first-type pixel to the first actual sub-pixel and the second actual sub-pixel of the target actual pixel, respectively; mapping grayscale data of the last theoretical sub-pixel of the target theoretical pixel marked as the second-type pixel to the last actual sub-pixel of the target actual pixel.

14. A display device comprising:

a plurality of rows of actual pixels, wherein each actual pixel includes a plurality of actual sub-pixels, and starting positions of the actual sub-pixels in odd-numbered and even-numbered rows are staggered by a distance of half of an actual sub-pixel;

wherein the display device further includes:

a determination circuit configured to determine a plurality of rows of theoretical pixels corresponding to a to-be-displayed image, wherein each theoretical pixel includes a plurality of theoretical sub-pixels, and each actual pixel corresponds to at least two theoretical pixels;

a calculation circuit configured to calculate grayscale data of each actual sub-pixel of each actual pixel;

wherein the calculation circuit includes:

a determination sub-circuit configured to, for a target actual pixel, determine a rendering mode for calculating the grayscale data of each actual sub-pixel of the target actual pixel according to whether there is a specified detail feature in a pixel area where target theoretical pixels corresponding to the target actual pixel are located, wherein when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed, wherein the determination sub-circuit is configured to:

when there is not a specified detail feature in the pixel area where target theoretical pixels are located, for a target actual sub-pixel of the target actual pixel, obtain a weighted average of grayscale data of the same-color theoretical sub-pixels in the target theoretical pixels;

determine grayscale data of the target actual sub-pixel according to the weighted average of grayscale data of the same-color theoretical sub-pixels.

15. A display device comprising: a processor, a memory, a computer program stored on the memory and executable on the processor, and a plurality of rows of actual pixels;

wherein each actual pixel includes a plurality of actual sub-pixels, and starting positions of the actual sub-pixels in odd-numbered and even-numbered rows are staggered by a distance of half of an actual sub-pixel;

wherein the computer program is executed by the processor to, determine a plurality of rows of theoretical pixels corresponding to a to-be-displayed image, wherein each theoretical pixel includes a plurality of theoretical sub-pixels, and each actual pixel corresponds to at least two theoretical pixels;

calculate grayscale data of each actual sub-pixel of each actual pixel;

wherein when calculating grayscale data of each actual sub-pixel of each actual pixel, the processor is configured to:

for a target actual pixel, determine a rendering mode for calculating the grayscale data of each actual sub-pixel of the target actual pixel according to whether there is a specified detail feature in a pixel area where target theoretical pixels corresponding to the target actual pixel are located, wherein when there is a specified detail feature in the pixel area where the target theoretical pixels corresponding to the target actual pixel are located and when there is not a specified detail feature in the pixel area where target theoretical pixels corresponding to the target actual pixel are located, different rendering modes are employed, wherein for a target actual pixel, when determining a rendering mode for calculating the grayscale data of each actual sub-pixel of the target actual pixel according to whether there is a specified detail feature in a pixel area where target theoretical pixels corresponding to the target actual pixel are located, the processor is configured to:

when there is not a specified detail feature in the pixel area where target theoretical pixels are located, for a target actual sub-pixel of the target actual pixel, obtain a weighted average of grayscale data of the same-color theoretical sub-pixels in the target theoretical pixels;

determine grayscale data of the target actual sub-pixel according to the weighted average of grayscale data of the same-color theoretical sub-pixels.

16. The display device according to claim 15, wherein in one row of the odd-numbered row and the even-numbered row of actual pixels, each actual pixel corresponds to two theoretical pixels; and each of the actual pixel and the theoretical pixels includes a first-color sub-pixel, a second-color sub-pixel and a third-color sub-pixel; grayscale data of the first-color sub-pixel, the second-color sub-pixel and the third-color sub-pixel of the actual pixels are calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

where $\partial 1+\beta 1=1$, Bs represents grayscale data of the first-color sub-pixel of the actual pixel, Rs represents grayscale data of the second-color sub-pixel of the actual pixel, and Gs represents grayscale data of the third-color sub-pixel of the actual pixel, Ba and Bb represent grayscale data of first-color sub-pixels of the two target theoretical pixels corresponding to the actual pixel, Ra and Rb represent grayscale data of second-color sub-pixels of the two target theoretical pixels corresponding to the actual pixel, and Ga and Gb represent grayscale data of third-color sub-pixels of the two target theoretical pixels corresponding to the actual pixel;

in the other row of the odd-numbered row and the even-numbered row of actual pixels, two boundary actual sub-pixels and multiple intermediate actual sub-pixels are included; each of the two boundary actual sub-pixels correspond to three theoretical pixels; each of the intermediate actual sub-pixels corresponds to two theoretical pixels;

a first boundary actual pixel of the two boundary actual pixels includes two first-color sub-pixels, one second-color sub-pixel and one third-color sub-pixel; and grayscale data of each actual sub-pixel of the first boundary actual pixel is calculated as:

$$Bs1=((\partial 2*Ba+\beta 2*Bb+r2*Bc)*0.5);$$

$$Bs2=Bs1;$$

$$Rs=(\partial 2*Ra+\beta 2*Rb+r2*Rc);$$

$$Gs=(\partial 2*Ga+\beta 2*Gb+r2*Gc);$$

where $\partial 2+\beta 2+\gamma 2=1$, Bs1 and Bs2 represent grayscale data of the two first-color sub-pixels of the first boundary actual pixel, Rs represents grayscale data of the second-color sub-pixel of the first boundary actual pixel, Gs represents grayscale data of the third-color sub-pixel of the first boundary actual pixel; Ba, Bb and Bc represent grayscale data of the first-color sub-pixels of the three target theoretical pixels corresponding to the first boundary actual pixel, respectively; Ra, Rb and Rc represent grayscale data of the second-color sub-pixels of the three target theoretical pixels corresponding to the first boundary actual pixel, respectively; and Ga, Gb and Gc represent grayscale data of the third-color sub-pixels of the three target theoretical pixels corresponding to the first boundary actual pixel, respectively;

a second boundary actual pixel includes one first-color sub-pixel, two second-color sub-pixels and two third-color sub-pixels; and grayscale data of each actual sub-pixel of the second boundary actual pixel is calculated as:

$$Bs=((\partial 3*Ba+\beta 3*Bb+r3*Bc));$$

$$Rs1=((\partial 3*Ra+\beta 3*Rb+r3*Rc)*0.5);$$

$$Rs2=Rs1;$$

$$Gs1=((\partial 3*Ga+\beta 3*Gb+r3*Gc)*0.5);$$

$$Gs2=Gs1;$$

where $\partial 3+\beta 3+r3=1$, Bs represents grayscale data of the first-color sub-pixel of the second boundary actual pixel; Rs1 and Rs2 represent grayscale data of the two second-color sub-pixels of the second boundary actual pixel; Gs1 and Gs2 represent grayscale data of the two third-color sub-pixels of the second boundary actual pixel; Ba, Bb and Bc represent grayscale data of first-color sub-pixels of three target theoretical pixels corresponding to the second boundary actual pixel, Ra, Rb and Rc represent grayscale data of second-color sub-pixels of three target theoretical pixels corresponding to the second boundary actual pixel; and Ga, Gb and Gc represent grayscale data of third-color sub-pixels of three target theoretical pixels corresponding to the second boundary actual pixel;

grayscale data of each actual sub-pixel of the intermediate actual pixel is calculated as:

$$Rs=\partial 1*Ra+\beta 1*Rb;$$

$$Bs=\partial 1*Ba+\beta 1*Bb;$$

$$Gs=\partial 1*Ga+\beta 1*Gb;$$

where $\partial 1+\beta 1=1$, Bs represents grayscale data of a first-color sub-pixel of the intermediate actual pixel; Rs represents grayscale data of a second-color sub-pixel of the intermediate actual pixel; Gs represents grayscale data of a third-color sub-pixel of the intermediate actual pixel; Ba and Bb represent grayscale data of first-color sub-pixels of two target theoretical pixels corresponding to the intermediate actual pixels, respectively; Ra and Rb represent grayscale data of second-color sub-pixels of two target theoretical pixels corresponding to the intermediate actual pixels, respectively; Ga and Gb represent grayscale data of third-color sub-pixels of two target theoretical pixels corresponding to the intermediate actual pixels, respectively.

17. The display device according to claim 15, wherein the specified detail feature includes at least one of the following:

oblique line;

vertical line;

point;

checkerboard.

18. The display device according to claim 17, wherein before, for a target actual pixel, determining a rendering mode for calculating the grayscale data of each actual sub-pixel of the target actual pixel according to whether there is a specified detail feature in a pixel area where target theoretical pixels corresponding to the target actual pixel are located, the processor is configured to:

obtain a pixel window corresponding to the target theoretical pixel, wherein the pixel window includes n rows and m columns of the theoretical pixels, n and m are positive integers; and determine whether there is a specified detail feature in the pixel window.

* * * * *